US006070622A

United States Patent [19]

Rutter

[11] Patent Number: 6,070,622

[45] Date of Patent: Jun. 6, 2000

[54] HIGH SPEED ASEPTIC FILLING MACHINE

[75] Inventor: Christopher C. Rutter, Oakland, Calif.

[73] Assignee: Packaging Systems, L.L.C., Romeoville, Ill.

[21] Appl. No.: 09/074,323

[22] Filed: May 7, 1998

[51] Int. Cl.[7] ..... B65B 1/04

[52] U.S. Cl. ..... 141/90; 141/2; 141/10; 141/11; 141/85; 141/91; 141/114; 141/116; 141/120; 141/129; 141/166; 141/250; 141/368

[58] Field of Search ..... 141/2, 10, 11, 141/45, 85, 90–92, 120, 114, 116, 129, 166, 181, 250, 284, 311 R, 346, 368, 383, 275; 137/563; 53/426

[56] References Cited

U.S. PATENT DOCUMENTS

| | | | |
|---|---|---|---|
| 3,874,430 | 4/1975 | Lansdale . | |
| 3,926,229 | 12/1975 | Scholle . | |
| 4,077,182 | 3/1978 | Papaluca . | |
| 4,417,607 | 11/1983 | Scholle et al. . | |
| 4,446,674 | 5/1984 | Inada . | |
| 4,458,734 | 7/1984 | Scholle et al. . | |
| 4,524,563 | 6/1985 | Sassi . | |
| 4,832,096 | 5/1989 | Kohlbach | 141/114 |
| 4,893,659 | 1/1990 | Loliger . | |
| 4,991,633 | 2/1991 | Wong . | |
| 5,099,895 | 3/1992 | Loeliger . | |
| 5,301,714 | 4/1994 | Johnson | 137/563 |
| 5,474,113 | 12/1995 | Rademacher et al. | 141/31 |
| 5,479,955 | 1/1996 | Roodvoets et al. . | |
| 5,865,221 | 2/1999 | Ludwig et al. . | |

FOREIGN PATENT DOCUMENTS

| | | |
|---|---|---|
| 2389538 | 5/1977 | France . |
| 2248599A | 4/1992 | United Kingdom . |

*Primary Examiner*—Steven O. Douglas
*Assistant Examiner*—Timothy L. Maust
*Attorney, Agent, or Firm*—Majestic, Parsons, Siebert & Hsue

[57] ABSTRACT

A filling head apparatus for filling a container in sterile conditions. The filling head comprises a regulating valve displaceable in three positions: open position, closed position, and displacement position. The inner wall of the spout of the container is cleaned by a pushing cylinder of the regulating valve traveling from the closed position to the displacement position. In addition, the filling head can freely move in respect to a sterile filling chamber encompassing the filling tip of the filling head. Furthermore, the filling head of the present invention comprises a diversion path to minimize the "water hammer" effect.

47 Claims, 23 Drawing Sheets

HIGH SPEED ASEPTIC FILLING MACHINE

BACKGROUND OF THE INVENTION

Many liquid and semi-liquid products are packaged into large containers for storage and distribution to repackagers, commercial uses and other users of large quantities of the product. Many of these products, particularly food products, deteriorate rapidly when exposed to oxygen. Additionally, food products must be protected against possible contamination from bacteria. Therefore, these products are often placed in large (e.g. one to six gallon) containers made of plastic or similar material and having one spout through which the container is filled and from which the product is dispensed from the container. These plastic containers are advantageous in that as the product is dispensed from the container, the container collapses around the remaining material so that no air enters the container. With container of a fixed shape or internal volume, air must enter the container to fill the volume left in the container as the product is dispensed. This air contains oxygen and frequently carries harmful bacteria. These containers typically have a rigid or semirigid plastic spout through which the product passes to enter or leave the container. In addition, care must be taken in packaging food products into the containers that no bacteria could enter the container that would create a potential health risk to the consumer of the food product.

To ensure the sterility, it is disclosed in U.S. Pat. No. 4,458,734 issued to Scholle et al. that the container is filled inside a filling chamber that maintains a sterile atmosphere around the spout of the container. The filling chamber is sterilized and is filled with a sterile gas, with the gas maintained in the chamber at a positive pressure with respect to the outside environment. The positive pressure of the gas ensures that no air from outside the chamber enters the chamber, as the flow through any opening in the chamber walls is from the higher pressure interior to the lower pressure exterior. A filling head is provided inside the chamber for filling the container with the fluid. An opening is then provided in the bottom of this chamber that is large enough to receive the spout of one of the plastic container food containers. Once the spout is placed in the opening, it is brought into contact with the filling head and the fluid is dispensed into the container.

One of the main deficiencies of the Scholle's invention is the lack of ability to clean the spout of the container. The spout of the container contributes to the contamination in two ways. First, after filling the fluid into the container, some residual fluid is stuck onto the inner wall of the spout opening of the container which then causes contamination to the fluid contained in the container. The other source of contamination is that bacteria stuck onto the inner surface of the spout is brought into the filling chamber when the spout of the container is lifted into the filling chamber. Therefore, in order to prolong the shelf life of the packaged products, a new method or apparatus is needed to reduce the two abovementioned contaminations.

In U.S. Pat. No. 4,893,659 issued to Loeliger, it is disclosed a filling head apparatus having valves at the tip of the head for regulating flow of a sterilizing medium and regulating flow of a fluid to be filled in a container to a filling head space. The Loeliger disclosure is directed to the resterilization of the spout opening of the container after filling and discloses a filling head combined with a sterilizing medium dispersion valve at the tip of the head to sterilize the spout of the container. However, the Loeliger's design specifically requires a steam outlet passage connected to the side of the tip of the filling head for the escape of the steam introduced. Therefore, for the Loeliger's system, an extra pipe is needed to connect to the tip of the filling head for the draining of the escaping steam. Because the sterile chamber is very small and the Loeliger disclosure requires this extra steam outlet connected to the tip of the filling head, the Loeliger's disclosure is not practical to be implemented in a sterile chamber. Therefore, a new design on the filling head is needed for the sterilization of the spout of the container.

Another aspect of the present invention is directed to an apparatus and a method of increasing the overall throughput of the filling apparatus by eliminating or minimizing the "water hammer" effect caused by the opening and closing of a fluid regulating valve. The water hammer effect usually occurs when the fluid flowing through the filling head into the container is quickly shut off. This hydraulic shock reduces the servicing life of the filling system by applying strong loads to the piping and filling head as well as causing noise. The effect is conventionally minimized by slowly shutting off the fluid flow to the filling head, however, with the expense of slowing down the filling process. Therefore, the entire system throughout deteriorates proportional to the slowing of the shut off valve. The present invention discloses a new and improved filling head to allow quick closure of the fluid flowing into the container while able to minimize the water hammer effect on the filling system.

SUMMARY OF THE INVENTION

It is an object of the present invention to provide a filling apparatus for aseptically filling a container.

It is another object of the present invention to provide a filling head that is able to clean the spout opening of the container.

It is a further object of the present invention to provide a filling head that can minimize or eliminate the water hammer effect.

It is a further object of the present invention to provide a design of the filling head and aseptic chamber assembly which reduces mechanical movement of various components.

The present invention relates to a high speed sterile filling system.

The high speed sterile filling system of the present invention comprises a novel design of a filling head having a pushing cylinder located at the tip of a regulating valve disposed inside the filling head for cleaning the inner wall of a spout opening of the container after each filling.

Another aspect of the present invention is the novel design of a filling head and filling chamber assembly. The filling head is able to move independently in respect to the filling chamber so that, between and during fillings, only the filling head is moved and the filling chamber and its accessories can remain stationary.

Another aspect of the present invention is the novel design of the filling head that is able to eliminate, or at least minimize, the "water hammer" effect caused by instantaneously shutting off the fluid flow between fillings. dr

DETAILED DESCRIPTION OF THE INVENTION

The present invention is directed to a high speed aseptic filling system designed to fill containers under sterile conditions.

Figure 1:
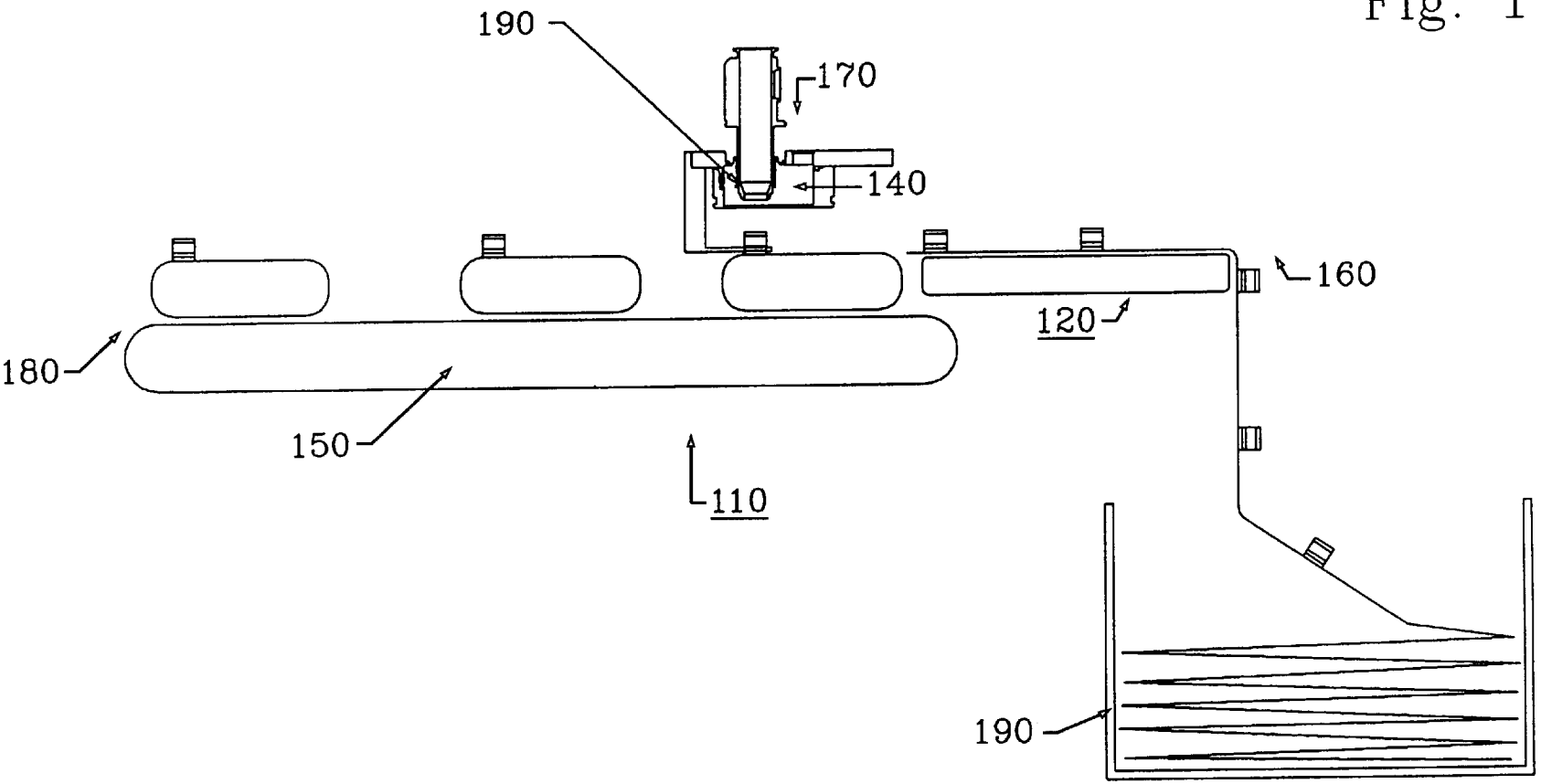
FIG. 1 illustrates a schematic diagram of the aseptic filling system of the present invention.

FIG. 1 provides a schematic diagram of the aseptic filling system of the present invention. The preferred embodiment of the aseptic filling system comprises a filling portion 110 and a transportation portion 120. The filling portion 110 comprises mechanisms for positioning the container for filling, an aseptic filling chamber for maintaining a sterile environment during filling, a decapper/capper for decapping and recapping the container before and after filling, and a specially designed filling head for filling the container and for subsequent cleaning of the spout opening of the container after filling. The transportation portion 120 of the filling system comprises a positioning mechanism to position the empty container to the filling portion 110 for filling, and a conveyor belt 150 for transporting the container out of the filling portion 110. The transportation portion 120 has an entry port 160, through which the empty container is fed, a filling area 170 where the container is filled, and a dispense port 180, through which the filled container is dispensed.

The container, which is to be filled with a fluid by the apparatus of the present invention, is preferably constructed of a flexible material, such as plastic. The container has a filling spout, preferably sealed by a removable cap. The filling spout of the container is used hereinafter as the fluid conduits with which the apparatus is used.

Different sizes of the containers can be accommodated by the present invention. In the preferred embodiment, one to six gallon containers are used.

In a preferred embodiment, the present invention utilizes premanufactured containers, connected in a continuous web. The containers have been prepackaged in a sealed overwrap container 190 and presterilized therein. The sealed overwrap container 190, comprises, for example a corrugated paper board, is positioned adjacent to the entry port 160. An operator manually grasps the end of the continuous web, pulls it through the opening, and operably connects it to the feed means of the apparatus, for example, by clipping the leading edge of this continuous web to the trailing edge of the preceding continuous web of containers.

FIG. 1 illustrates that when the container is positioned below the filling chamber 140, the spout of the container is then raised into the filling chamber 140. In one embodiment of the present invention, a decapper/capper 560 (not shown in FIG. 1) is located inside the filling chamber 140 for (1) removing the cap covering the spout opening of the container before each filling, and (2) subsequently recapping the container after the filling is completed. In the preferred embodiment, the decapping, filling and recapping are all performed inside the filling chamber 140 so that no contamination is introduced into the container. After the container is completely filled, the container is advanced out of the filling portion 110 by the conveyor belt 150 to the dispense port 180. A severing bar disconnects adjacent filled containers at perforations in the container web between adjacent containers, so that the containers may be deposited into protective enclosures, such as corrugated paper board boxes.

Figure 2:
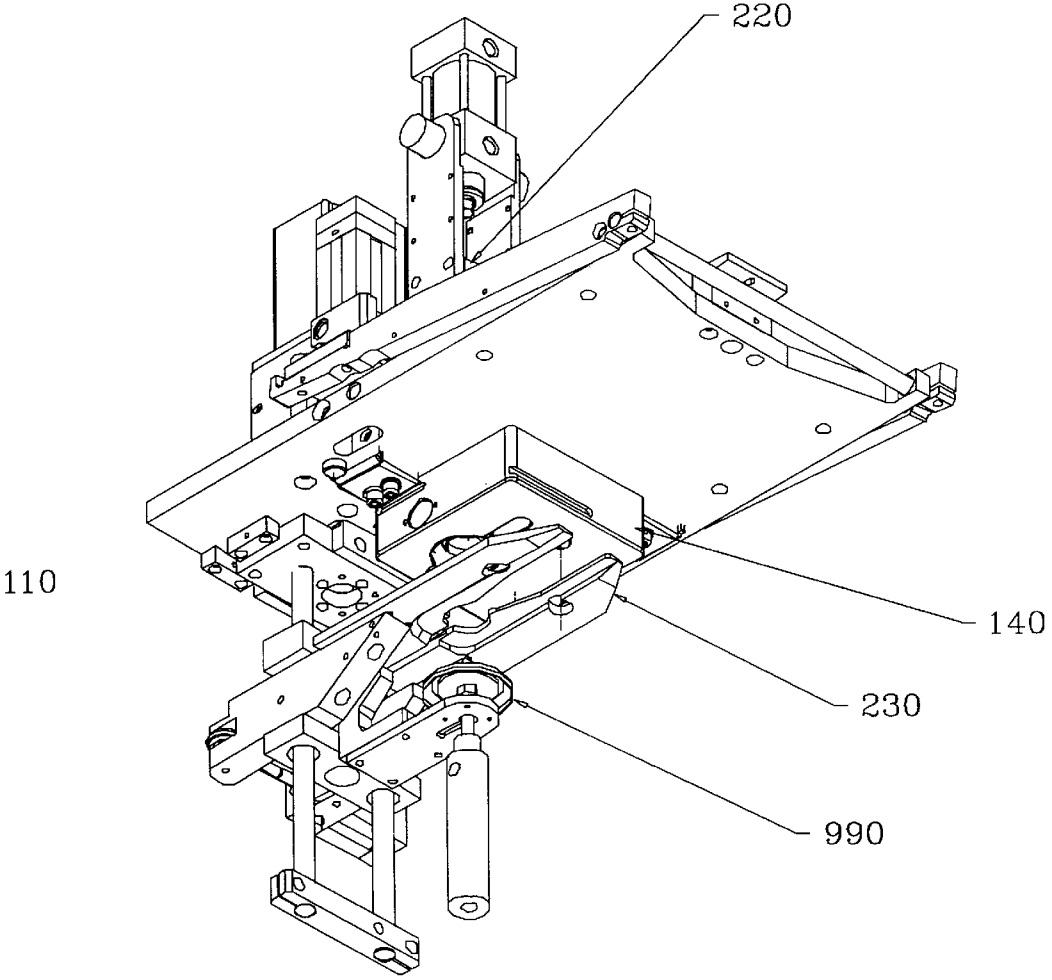
FIG. 2 illustrates a perspective view of a filling portion of Preferred embodiment.

FIG. 2 illustrates a perspective view of the filling portion 110 of a preferred embodiment of the present invention. The filling portion 110 of the present invention includes a sterile filling chamber 140, defined by a top plate, a bottom plate and side walls. A filling head 220 having a filling tip (not shown) enters the filling chamber 140 through an opening in the top plate and ends with its filling tip inside the filling chamber 140. The filling head 220 is connected with a filling tube which conducts a fluid, such as a liquid or viscous material, from a source to the filling head 220 and then fills the container through the tip of the filling head 220.

In addition, as shown in FIG. 2, the present invention also comprises a spout gripper 230 that holds and lifts the spout of the container into the filling chamber 140 through an opening on the bottom plate of the filling chamber 140. In the preferred embodiment of the present invention, the gripper 230 comprises a pair of handling plates shaped with the curvature of the spout. The spout of the container is gripped by the movements of the pair of handling plates. In addition, the spout gripper 230 also travels in a vertical motion perpendicular to the grabbing movements to lift the spout of the container into the filling chamber 140.

In a preferred embodiment, a clamp pad 990 is positioned under the filling head 220 to facilitate the cleaning of the spout opening after filling. After the completion of filling, the clamp pad 990 located directly below the lower edge of the spout opening raises and presses the bottom of the container against the lower edge of the spout opening. By pressing the bottom of the container against the bottom edge of the spout, the interior of the container is isolated from the spout opening during the subsequent spout cleaning process.

An important aspect of the present invention is the design of the filling chamber 140 of the aseptic filling system.

Figure 3:
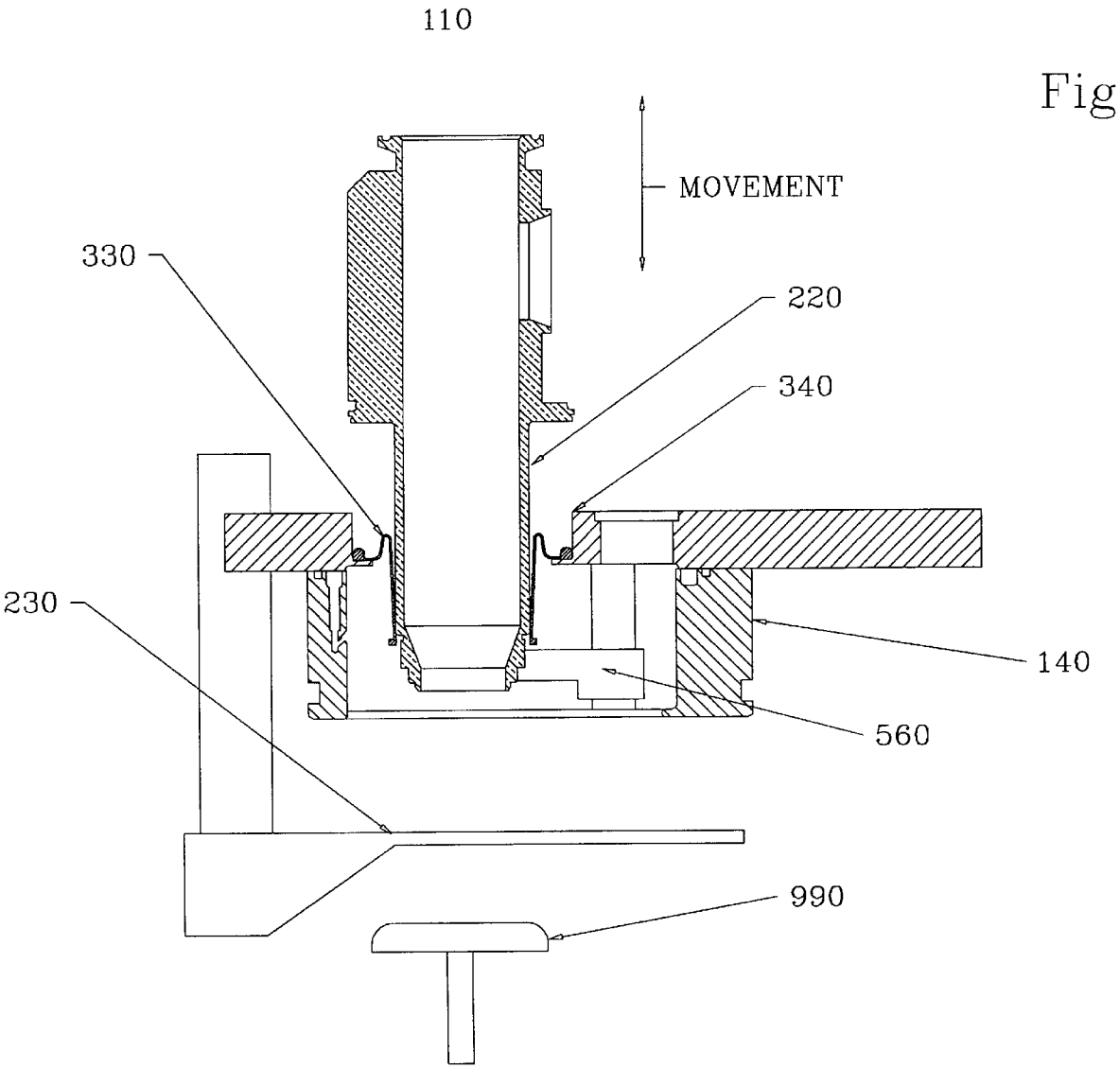
FIG. 3 illustrates a cross section diagram of the filling portion of a preferred embodiment.

FIG. 3 shows the detail of the filling portion 110 comprising a filling chamber 140 which is maintained to be sterile at all time during filling by maintaining positive pressure of sterile gases/fluid or steam inside the chamber, a filling head 220 for delivering fluid to the container, a cap decapper/capper 560 located inside the filling chamber 140 for removing and reinstalling the caps covering the spout of the container, a spout gripper 230 for grabbing and lifting the spout of the container into and out of the filling chamber 140, and a clamp pad 990 for facilitate the cleaning of the spout opening.

In the preferred embodiment as shown in FIG. 3, the filling head 220 is pivotally connected to the filling chamber 140 to allow vertical movement of the filling head 220 in respect to the filling chamber 140. A rolling diaphragm seal 330 is positioned between the filling head 220 and the opening 340 located in the top plate of the filling chamber 140 for sealing the circumferential spacing between the filling head 220 and the top plate to prevent any contaminations from entering the sterile filling chamber 140. The rolling diaphragm seal 330 is preferably made of elastic plastics so that the filling head 220 is allowed to move freely in a vertical motion to engage and disengage with the spout opening of the container without allowing any contaminations to enter the sterile filling chamber 140.

Figure 4:
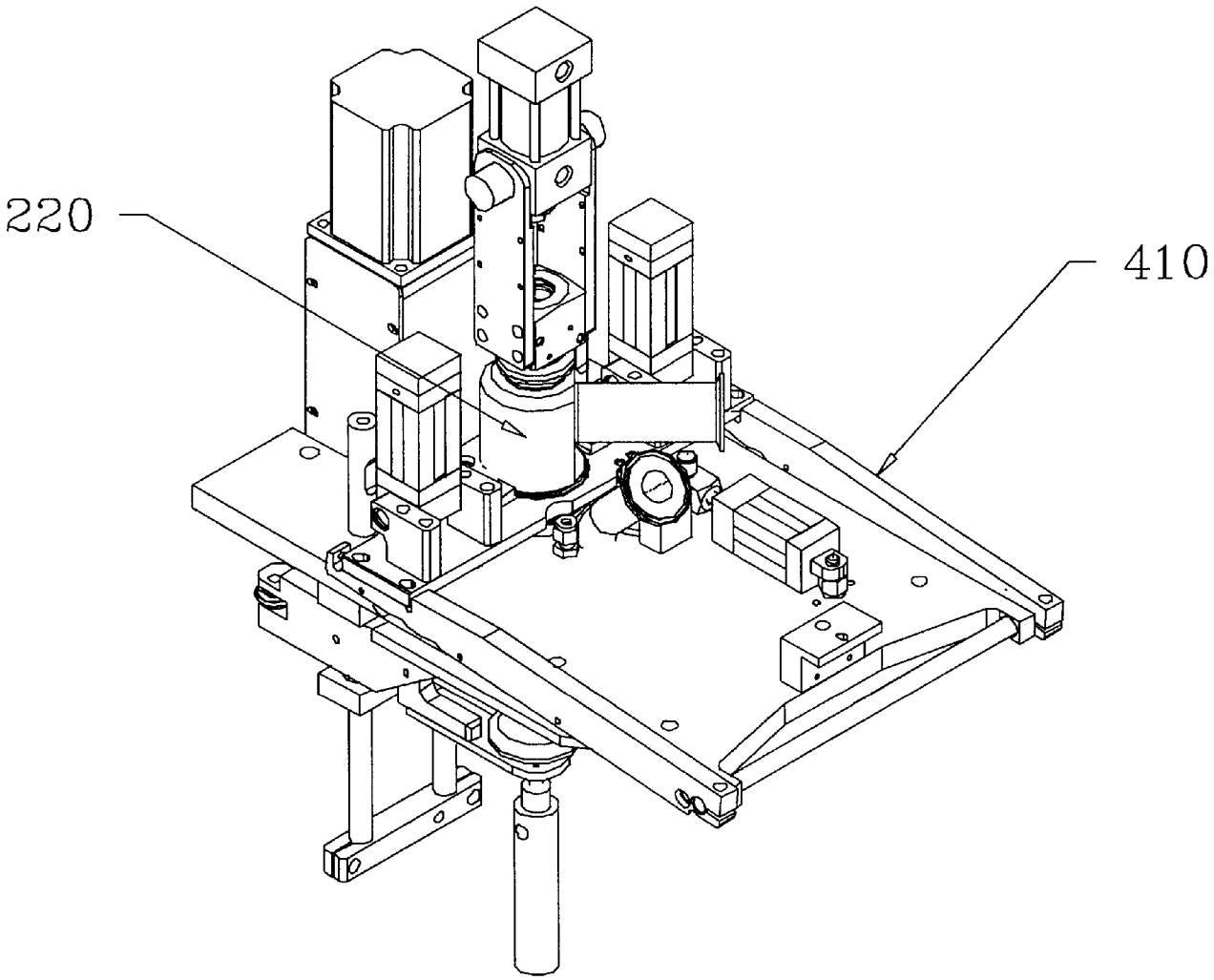
FIG. 4 illustrates a perspective view of a filling head connecting with a filling chamber.
Figure 5:
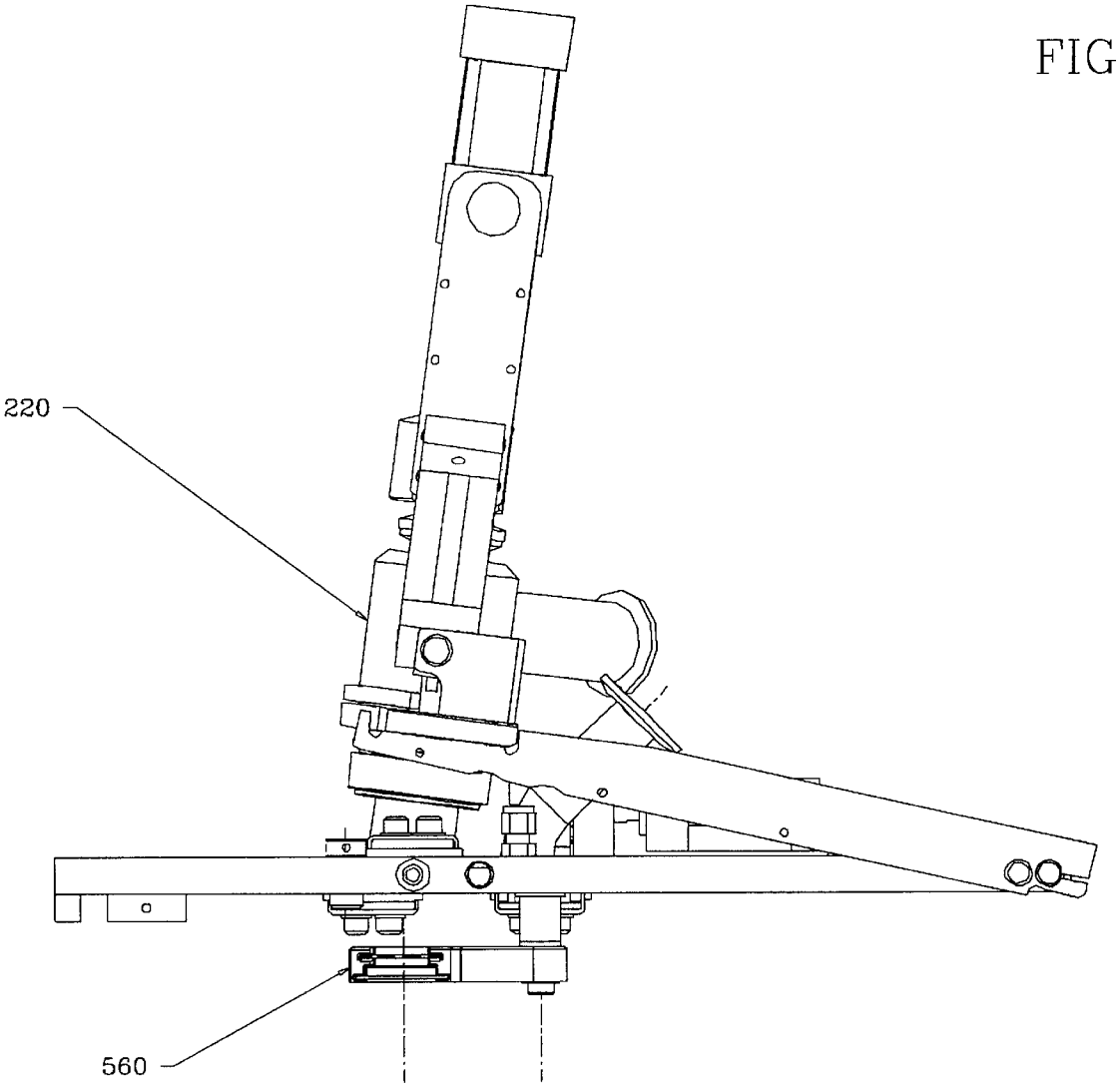
FIG. 5 illustrates the raised position of the filling head.
Figure 6:
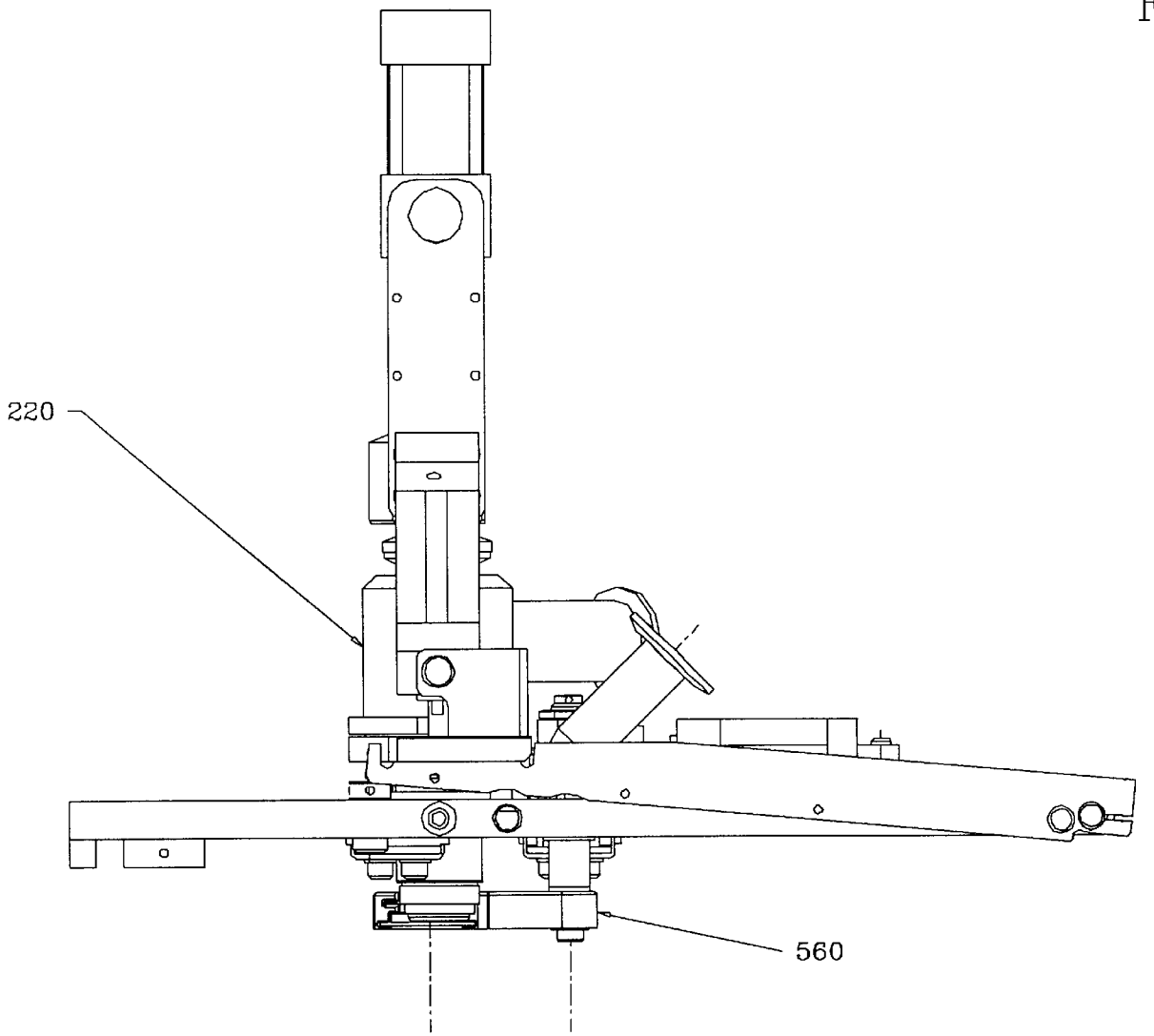
FIG. 6 illustrates the downward position of the filling head.

FIGS. 4, 5, and 6 show different views of the preferred embodiment of the filling head assemblies of the present invention. As shown in the figures, the filling head 220 is connected with the filling chamber 140 by a hinge 410 so that the filling head 220 can be moved freely in a vertical motion in respect to the aseptic filling chamber 140. By allowing the filling head 220 to move freely in respect to the aseptic filling chamber 140, the entire filling system can be simplified because less components are needed to move during each filling and the filling chamber 140 can stay stationary during each filling.

As illustrated in FIG. 5, the filling head 220 of the present invention is in an upward position. The filling head 220 is raised pivotally upward to allow the spout of the container to enter into the filling chamber 140, and allow the decapper 560 to decap the spout of the container.

FIG. 6 shows that the filling head 220 is in a downward position. In this position, the filling head 220 is pivotally traveled downward so that the filling tip of the filling head 220 presses against the upper edge of the spout of the container to prevent any contamination from entering the container during the filling.

It should be emphasized that, as shown in FIGS. 4, 5, and 6, only the filling head 220 is moved during each filling. The filling chamber 140, decapper/capper, and other mechanisms remain in the same position during each filling. This arrangement greatly reduces the movement of each component in the filling system, which thereby allows faster filling for each container.

The detail operations of the filling head 220 and the filling chamber 140 are explained in detail below.

Figure 7:
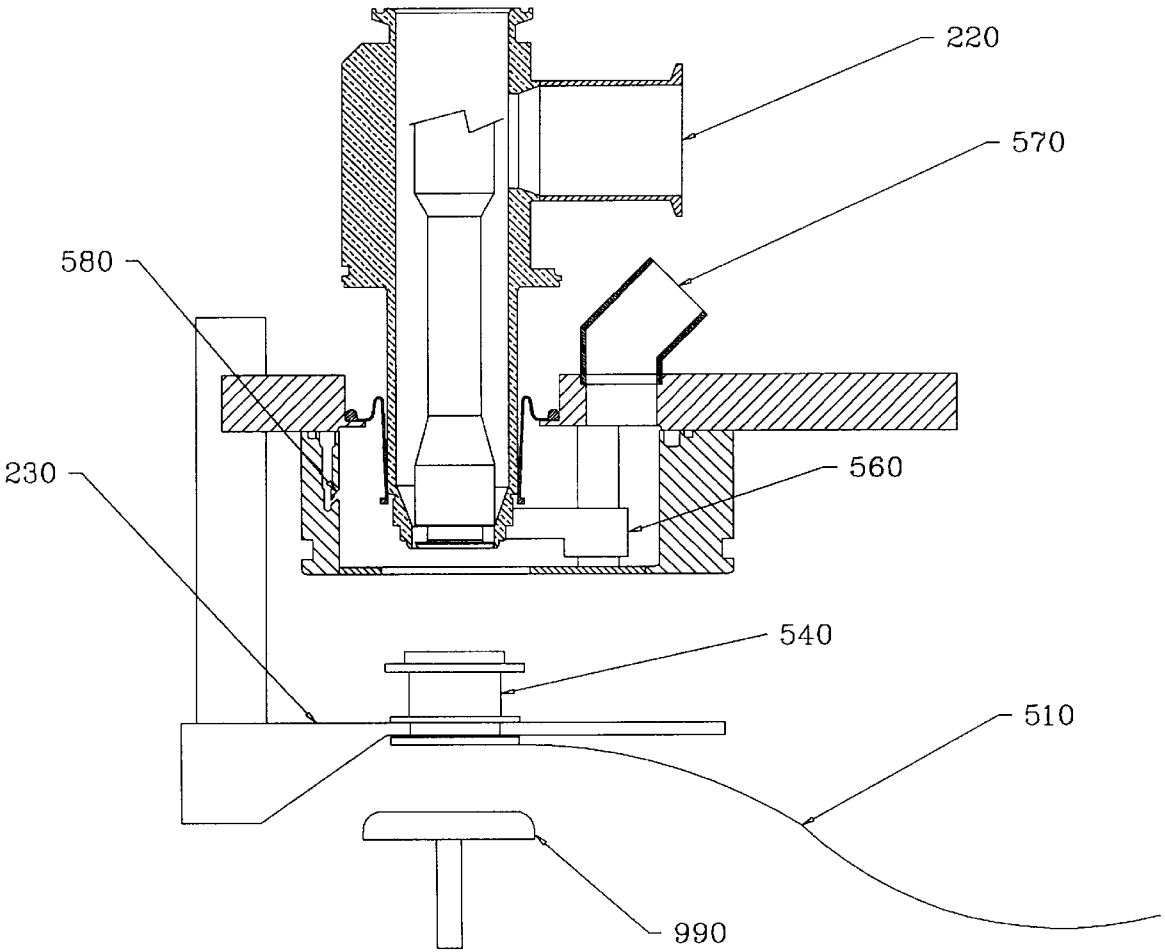
FIG. 7 illustrates a cross section diagram of a preferred embodiment of the filling head, filling chamber and container.
Figure 7A:
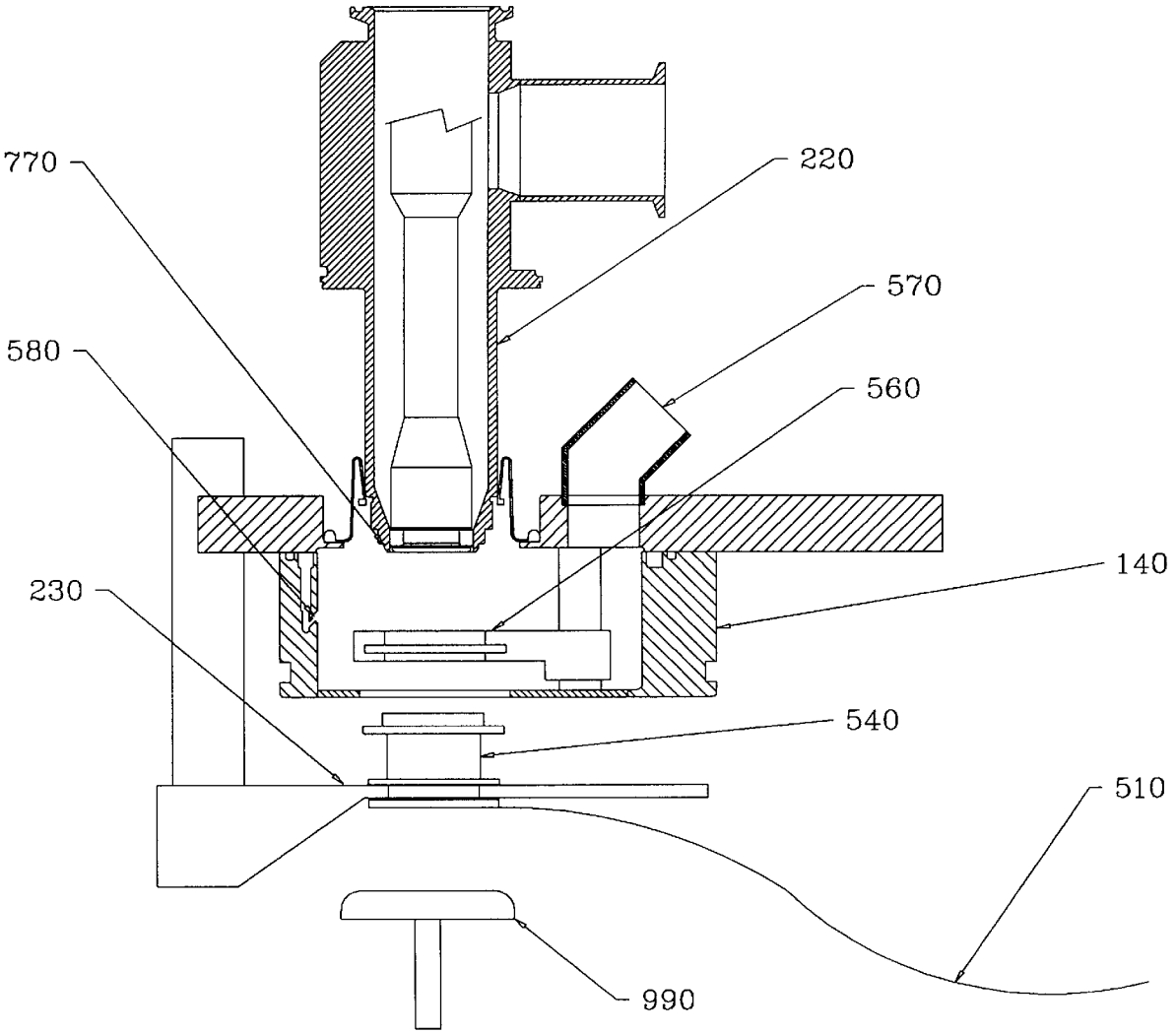

FIG. 7 shows, in the preferred embodiment, that when a container 510 is positioned under the filling chamber 140, the gripper 230 grabs the spout 540 of the container 510 and lifts the spout 540 into the filling chamber 140 so that the spout is engaged with the filling head 220. The gripper 230 comprises a pair of handling plates shaped to the curvature of the spout 540 for securely grabbing the spout 540. Both the grabbing motion and the vertical lifting motion can be actuated by high speed heavy duty air cylinders.

In a preferred embodiment that the spout 540 of the container 510 is capped, once the spout 540 of the container 510 is positioned inside the filling chamber 140 by the gripper 230, a decapper/capper 560 located inside the filling chamber 140 decaps the spout 540 and exposes the spout opening for filling.

In the preferred embodiment of shown in FIG. 7, a sterile air inlet 570 is provided to direct air or other sterile gas to the filling chamber 140 to create a positive pressure inside the filling chamber 140. The gas used for sterilizing can be steam, or a sterile gas that contains no oxygen to maximize the shelf life of the product being packaged into the container 510. The gas is supplied to the chamber in a sufficient quantity that the pressure inside the chamber is greater than that of the environment outside the chamber. This positive pressure ensures that if there are any leaks around filling tube or in the holes on the top and bottom plates, the gas from inside the chamber will escape to the outside environment. This prevents the air from outside the chamber, with the bacteria it may contain, from entering the filling chamber 140, and preserves the sterility of the chamber.

In a preferred embodiment of the present invention, a sanitizing fluid spray jet 580 is placed inside the filling chamber 140 for providing sanitizing fluid to the interior of the filling chamber 140. By pointing the spray jet at the filling tip 770 of the filling head 220, the filling head 220 can be cleaned both before and after each filling.

Figure 8:
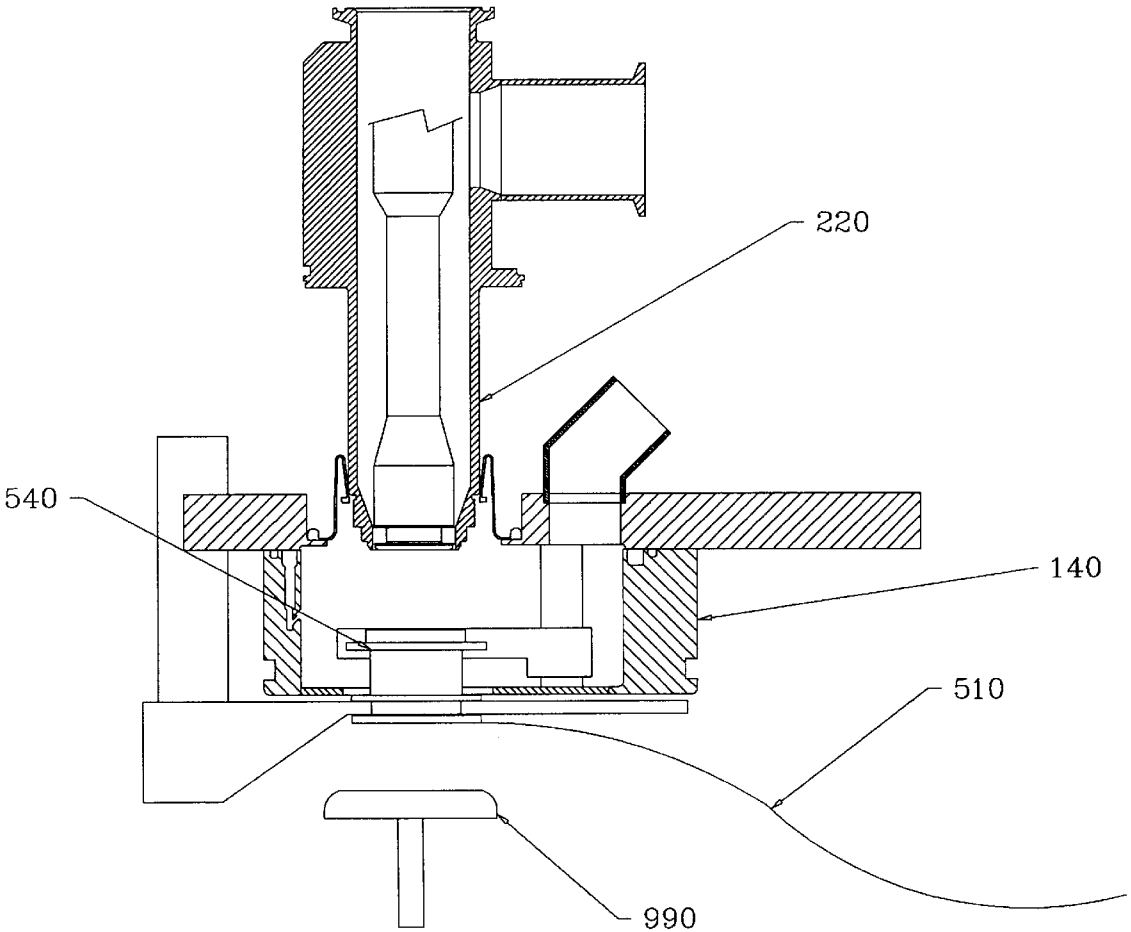
FIG. 8 illustrates a beginning position of the filling head.

FIG. 8 shows a beginning position of the filling head 220 when an empty container 510 is positioned under the filling chamber 140. In this position, the filling head 220 is raised to allow the spout 540 of the container 510 to enter the filling chamber 140 through the opening in the lower plate.

Figure 9:
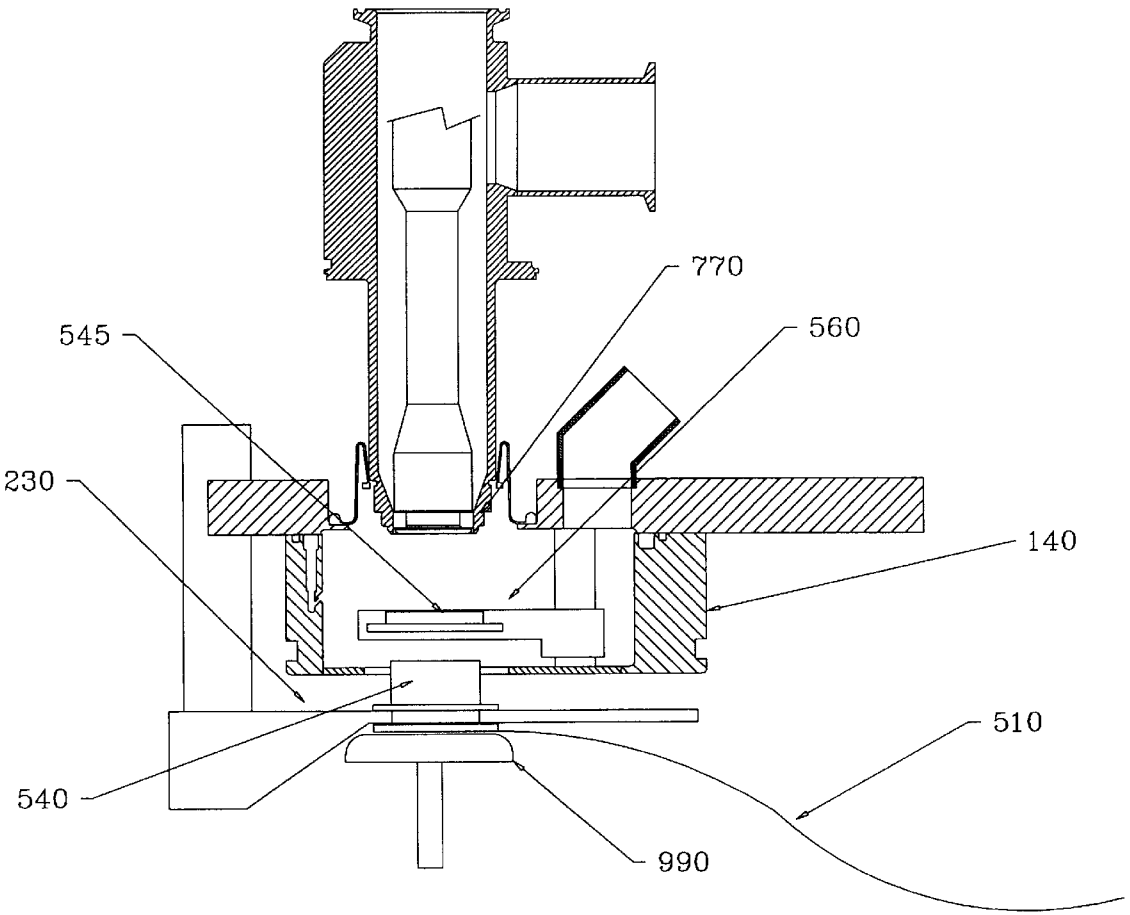
FIG. 9 illustrates that the spout of the container is lifted into the filling chamber.

FIG. 9 shows that, after the gripper 230 lifts the spout 540 of the container 510 into the filling chamber 140, the cap 545 of the container 510 is then removed by the decapper/capper 560 located inside the filling chamber 140. In addition, the spout 540 is aligned by the gripper 230 in a position below the filling head 220 so that the spout opening is directly under the filling tip 770.

Figure 10:
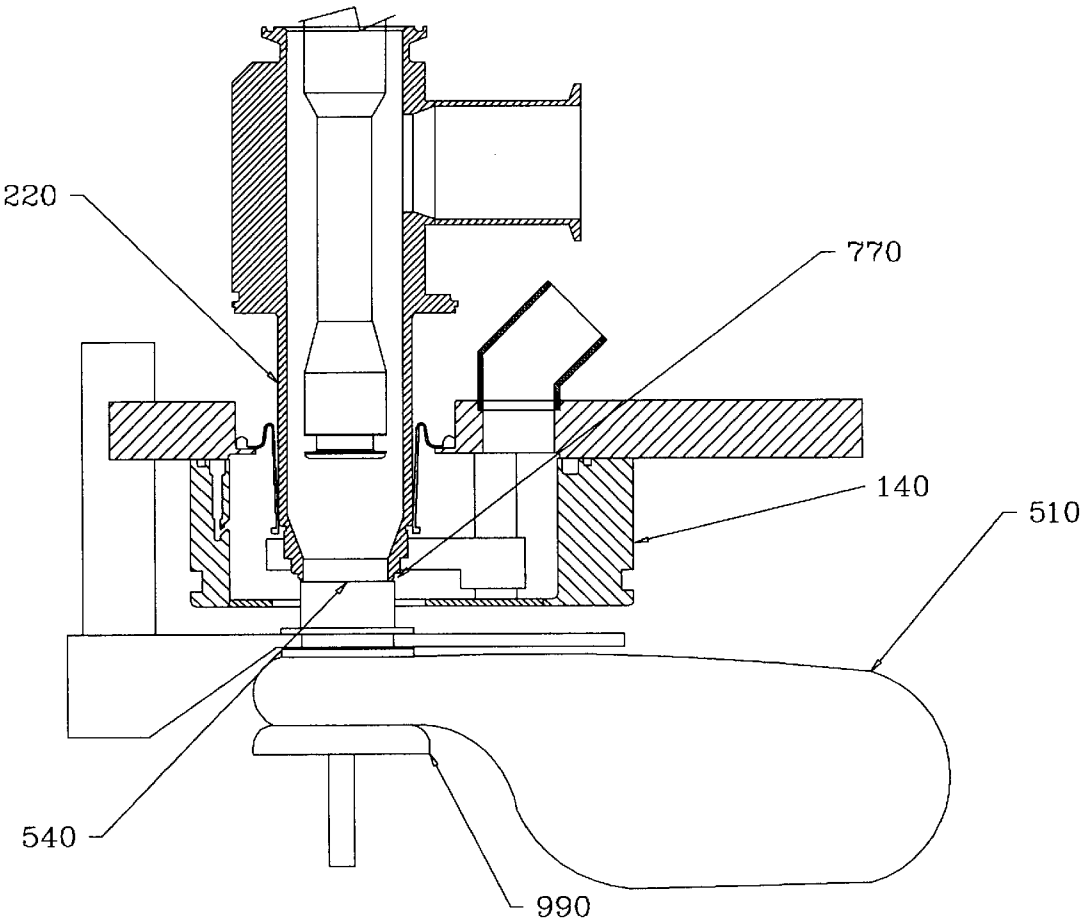
FIG. 10 illustrates that the filling head is lowered for filling.

FIG. 10 shows that, after the cap of the container 510 is removed, the filling head 220 is lowered and the lower edge of the filling tip 770 is pressed against the upper edge of the spout 540 of the container 510. The fluid is then delivered into the container 510 by the filling head 220 through the filling tip 770 and the spout 540 of the container 510.

In a preferred embodiment, the filling speed is about 14 to 16 containers per minute on 2.5 gallon containers. The flow rate is about 100 gallon per minute, and the pressure at the inlet is about 30 to 35 psi.

Figure 11:
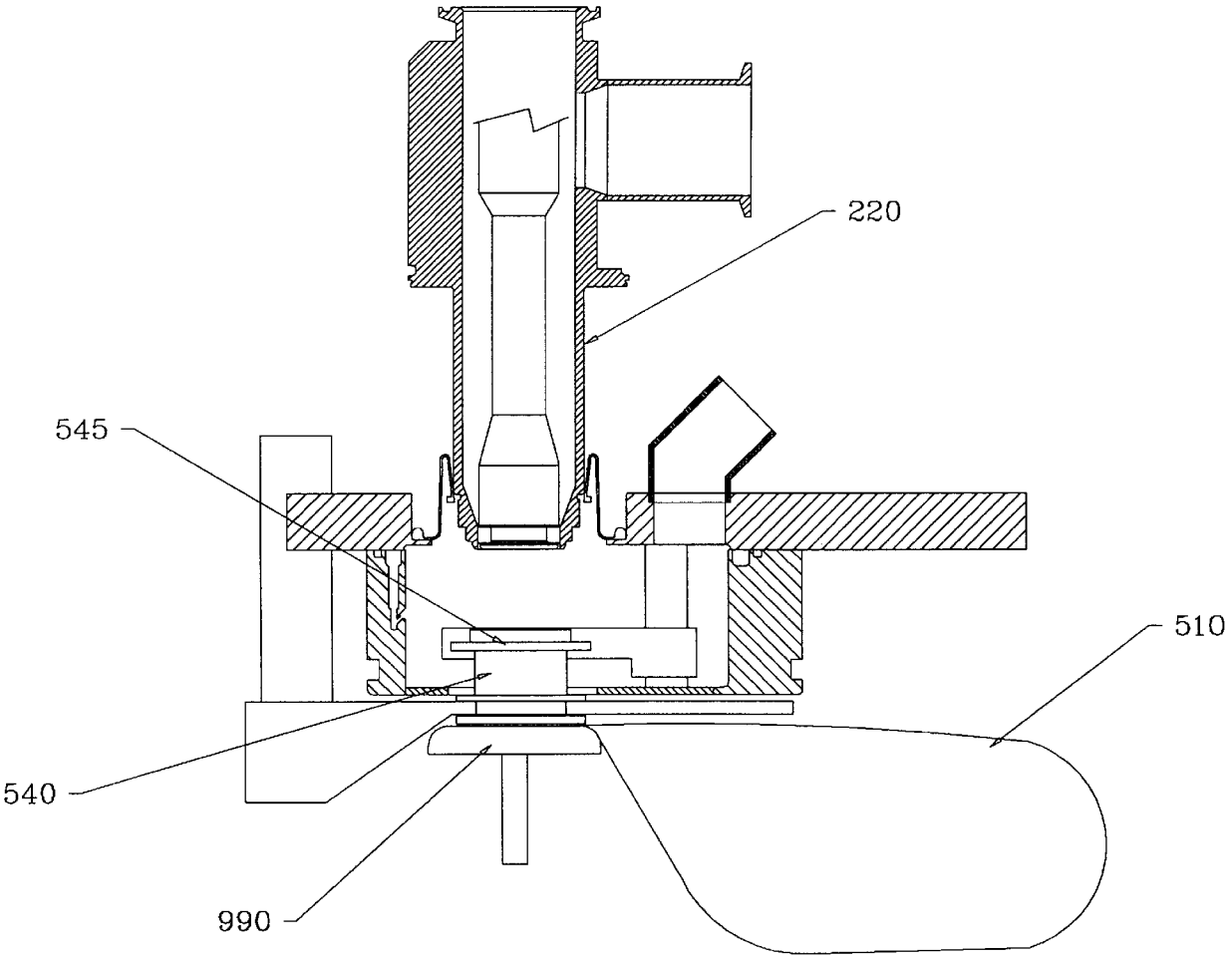
FIG. 11 illustrates that the cap of the container is replaced after filling.

FIG. 11 shows that the filling head 220 is raised and the cap is replaced onto the spout 540 of the container 510 for sealing after the filling is completed. Note that in this position, the clamp pad 990 is pushed upwardly so that the bottom of the container 510 presses against the lower edge of the spout 540 of the container 510. By pressing the bottom of the container 510 onto the lower edge of the spout 540, no residual fluid and contaminations can enter the interior of the container 510 during the process of cleaning and recapping.

Figure 12:
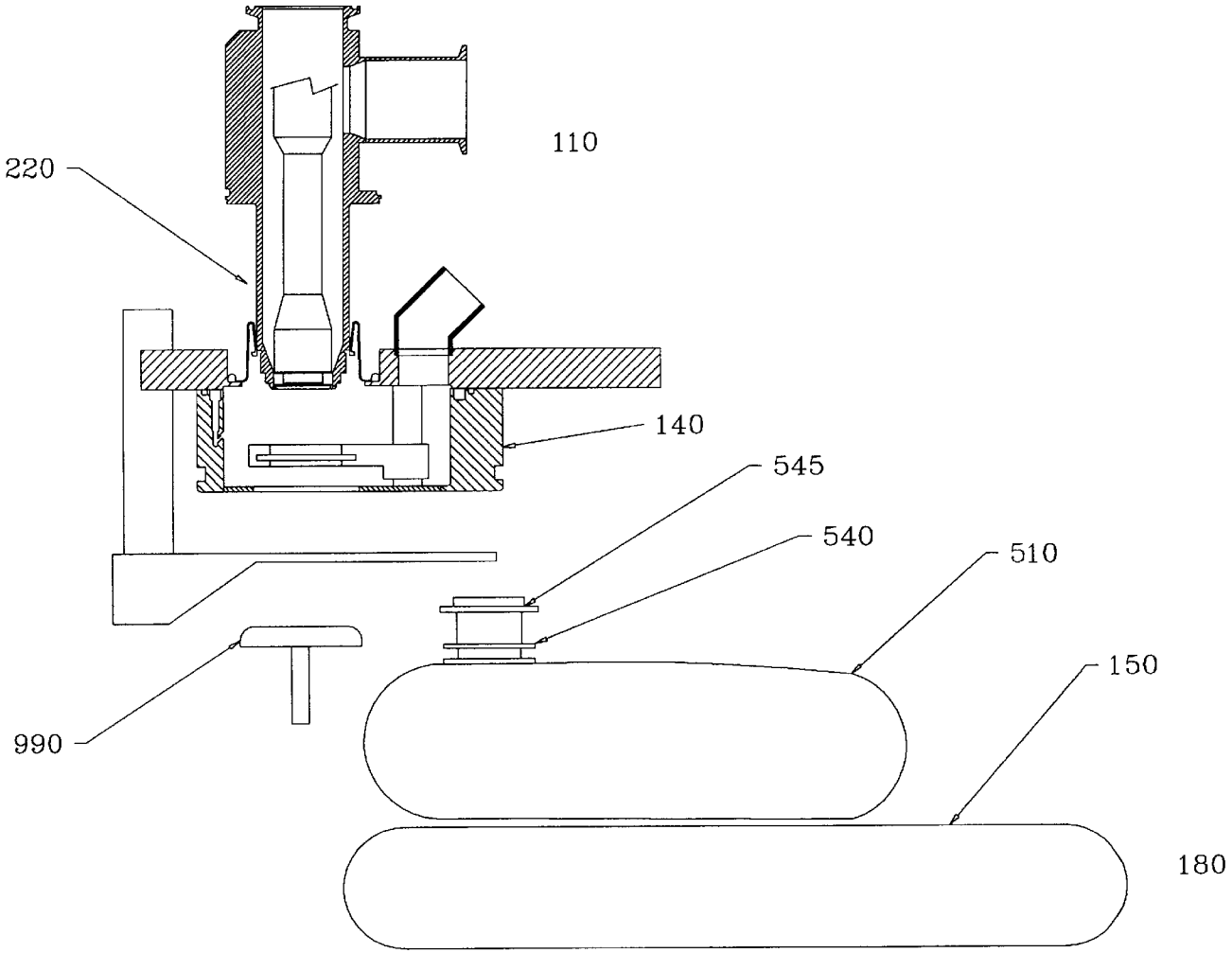
FIG. 12 illustrates that the filled container is lowered after filling.

FIG. 12 shows that, after the cap is placed back onto the spout 540 of the container 510, the container 510 filled with fluid is then lowered onto the conveyor belt 150 for transporting to the dispense port 180 for packing. In this position, various components in the filling portion 110 of the filling system including the filling head 220 and the clamp are returned to the beginning positions in preparation of another empty container 510.

Another aspect of the present invention is the cleaning functions of the filling head 220.

Figure 13:
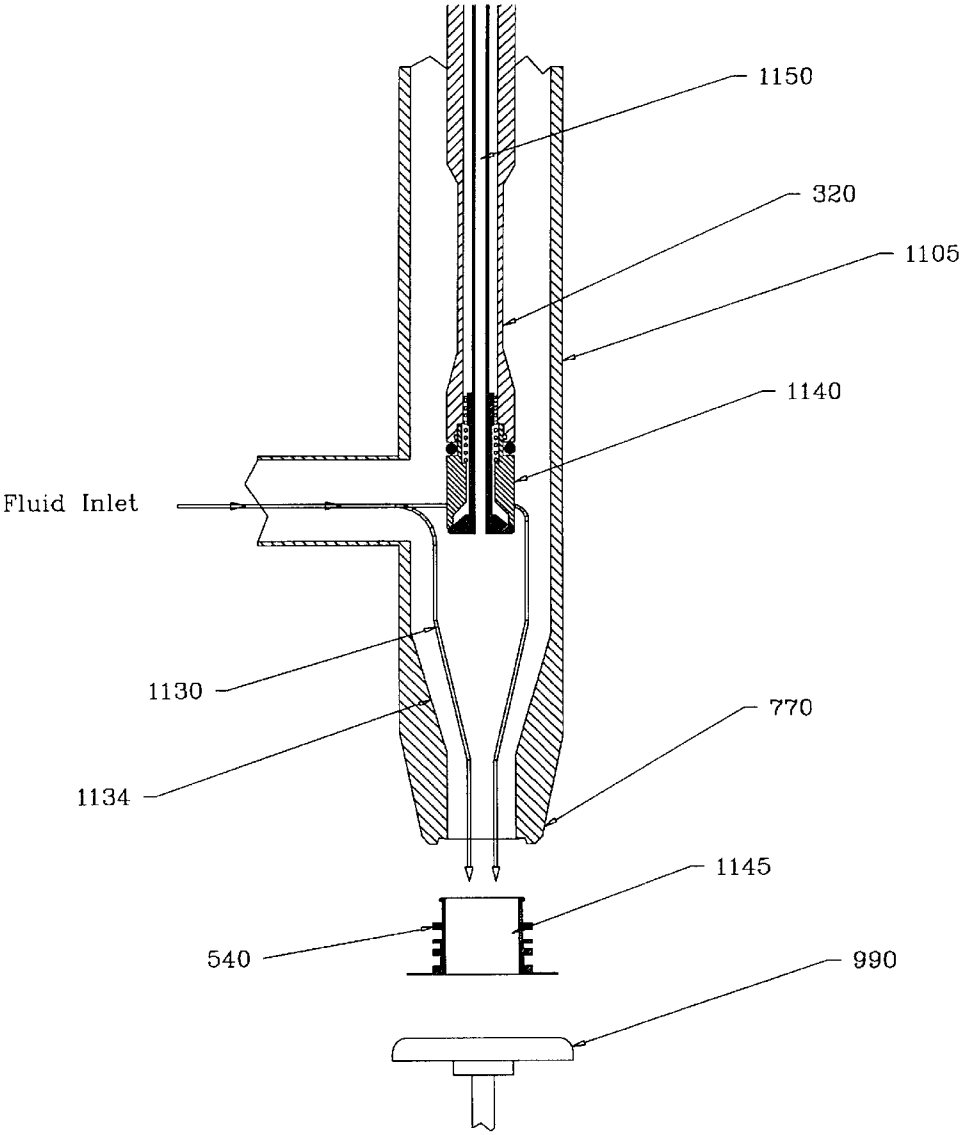
FIG. 13 illustrates a cross section diagram of the filling head of another preferred embodiment.

FIG. 13 show a preferred embodiment of the filling head 220 of the present invention. The filling head 220 comprises a filling head housing 1105 having a fluid inlet portion and a filling tip 770. The fluid inlet portion is for receiving fluid to be filled into the container 510, whereas the filling tip 770 is for engaging with the spout 540 of the container 510 to transfer the fluid to the container 510.

In the preferred embodiment, the filling head 220 further comprises a regulating valve 320 encompassed by the filling head housing 1105. The regulating valve 320 is designed for coaxial movement and is vertically displaceable inside the housing 1105. As shown in FIG. 13, a fluid passage 1130 is formed circumferentially between the regulating valve 320 and the narrowing inner wall 1134 of the housing 1105. By moving the regulating valve 320 along the longitudinal axis of the housing, the flow of the fluid from the filling head 220 into the container 510 can be regulated. For example, the fluid is allowed to flow into the container 510 through the filling tip 770 when the regulating valve 320 is in the upward position. The fluid flowing into the container 510 is stopped when the regulating valve 320 is moved downward to block the fluid passage 1130.

The regulating valve 320 as shown in FIG. 13 further comprises a pushing cylinder 1140 at one end. In the preferred embodiment as shown, the pushing cylinder 1140 is designed to travel beyond the top end of the filling tip 770 and protrude inside the spout opening 1145 of the container 510. When the container 510 is filled, the extended pushing cylinder 1140 of the regulating valve 320 can move beyond the filling tip 770 and into the spout opening 1145 to remove the fluid stuck inside the spout opening 1145. By extending the pushing cylinder 1140 into the spout opening 1145, the residual fluid located inside the spout opening 1145 can be squeezed out of the spout opening 1145 and into the container 510.

FIG. 13 shows that, after the container 510 is positioned below the filling chamber 140, the spout 540 is lifted into the opening to the filling chamber 140 by the gripper 230 (gripper 230 not shown in FIG. 3). The filling tip 770 of the filling head 220 is then lowered to engage with the top edge of the spout 540. Note that during the entire filling operation, the regulating valve 320 of the filling head 220 is in an upward open position which allows a fluid passage 1130 to be formed between the inner wall 1134 of the filling head housing 1105 and the tip of the elongated regulating valve 320 to allow the fluid flowing into the container 510 though the filling head housing 1105. It should also be pointed out, during the filling the clamp pad 990 is in the downward position to allow the fluid to enter the container 510.

Figure 14:
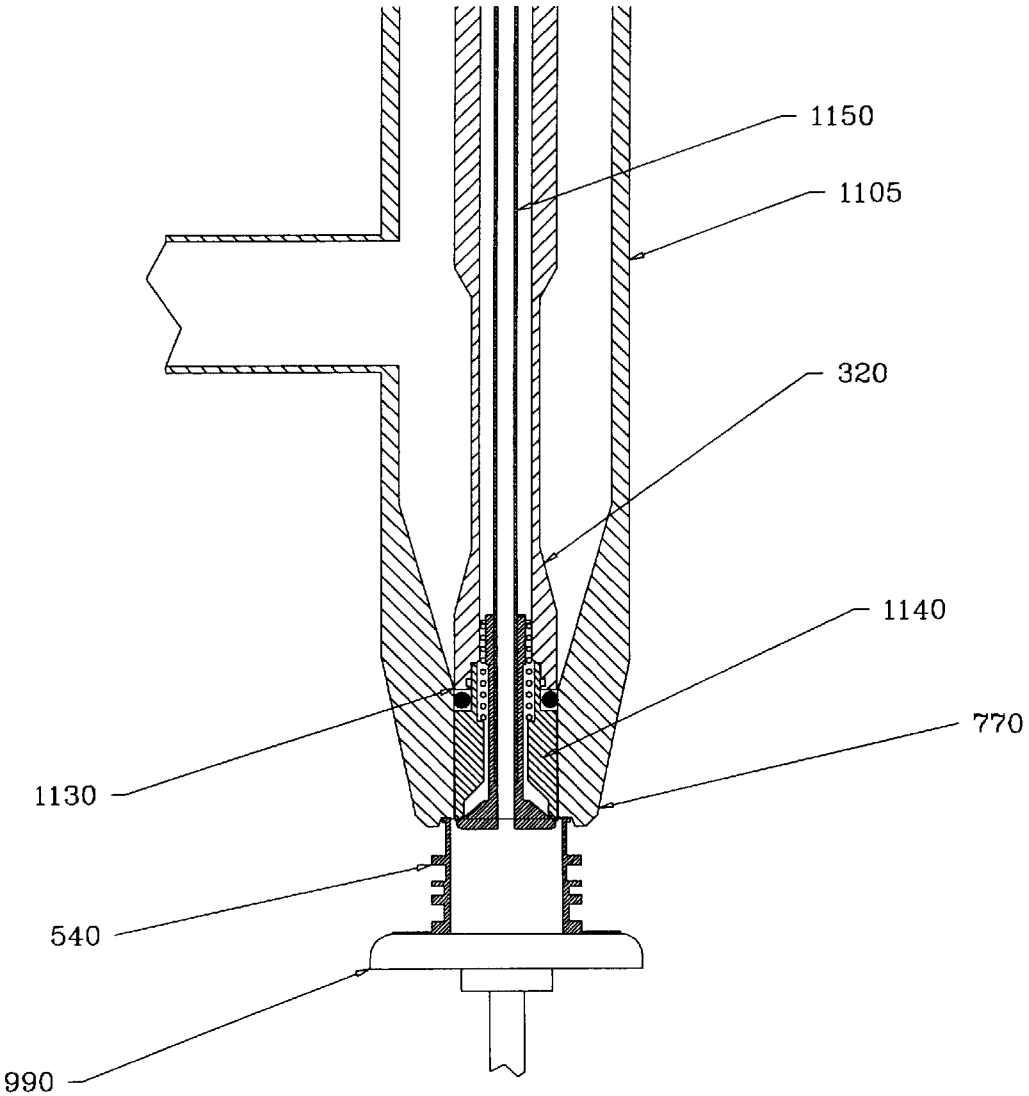
FIG. 14 illustrates the closed position of the regulating valve.

FIG. 14 shows that when the system detects a sufficient amount of liquid is transferred into the container 510, the fluid passage 1130 is shut off to prevent any further fluid in entering the container 510. In this position, the regulating valve 320 is lowered to block the fluid passage 1130. In the preferred embodiment as shown, the diameter of the regulating valve 320 is sized to be approximately equal to the inner diameter of the narrowing portion of the filling head housing 1105 so that the fluid passage 1130 is completely sealed when the regulating valve 320 is in the downward position.

Figure 15:
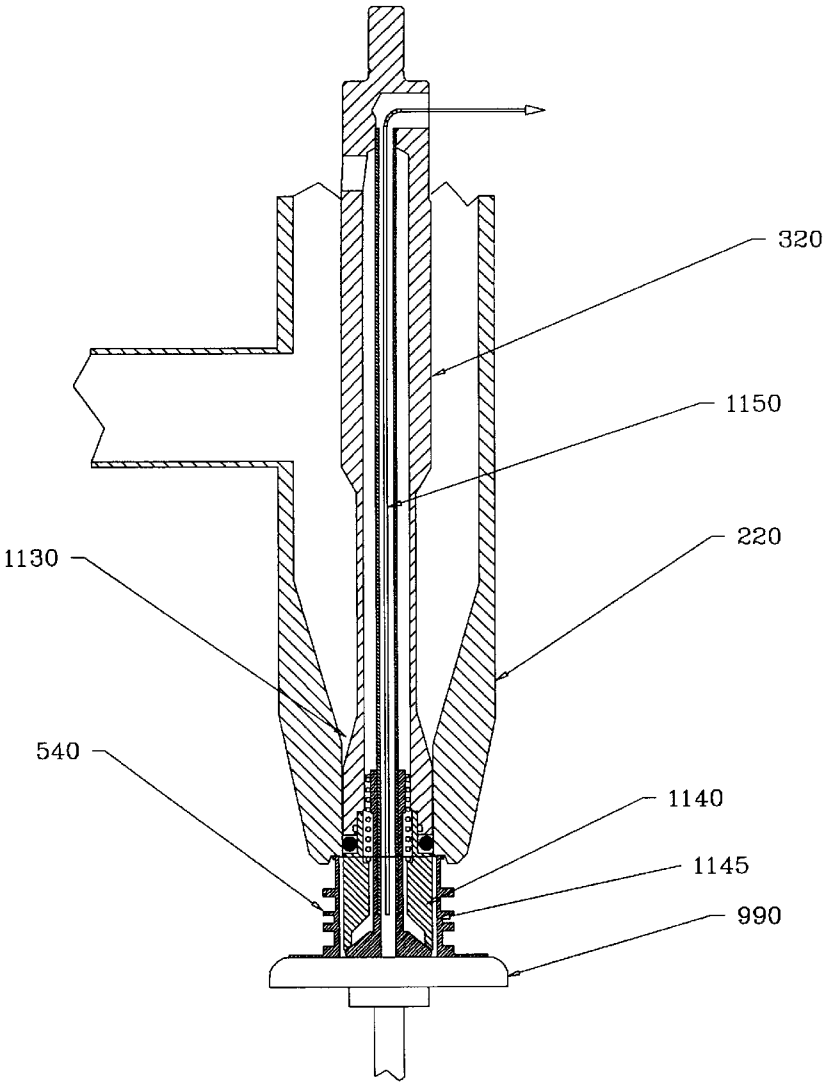
FIG. 15 illustrates the displacement position of the regulating valve.

FIG. 15 shows the filling head 220 and the spout 540 in a "displacement position." The diameter of the pushing cylinder 1140 is designed to be substantially equal to the inner diameter of the spout opening 1145 so that when the pushing cylinder 1140 travels from the closed position to this displacement position, the circumferential edge of the pushing cylinder 1140 squeezes against the inner wall of the spout opening 1145 and thereby removes any residual stuck onto the inner wall of the spout opening 1145. FIG. 15 further shows a residual escape path 1150 located inside the regulating valve 320. When the pushing cylinder 1140 is forced downward into the spout opening 1145, the residual fluid is then forced out of the spout opening 1145 into the container 510. It should be noted that the clamp pad 990 is raised to the upward position for sealing the interior of the container 510 from the spout opening after the pushing cylinder 1140 travels from the closed position to the displacement position. By maintaining the clamp pad 990 in the upward position during the spout cleaning process, the bottom of the container 510 is pressed against the bottom edge of the spout opening 1145 to prevent any residual fluid from entering the container 510.

In the preferred embodiment of the present invention as shown in FIGS. 13–15 , a residual escape path 1150 is located inside the pushing cylinder 1140 to assist residual fluid or air to escape from the spout opening 1145. Furthermore, in another preferred embodiment of the present invention (not shown), the residual escape path 1150 is connected to a siphon pump to facilitate the escape of the residual out of the spout opening 1145.

Figure 16:
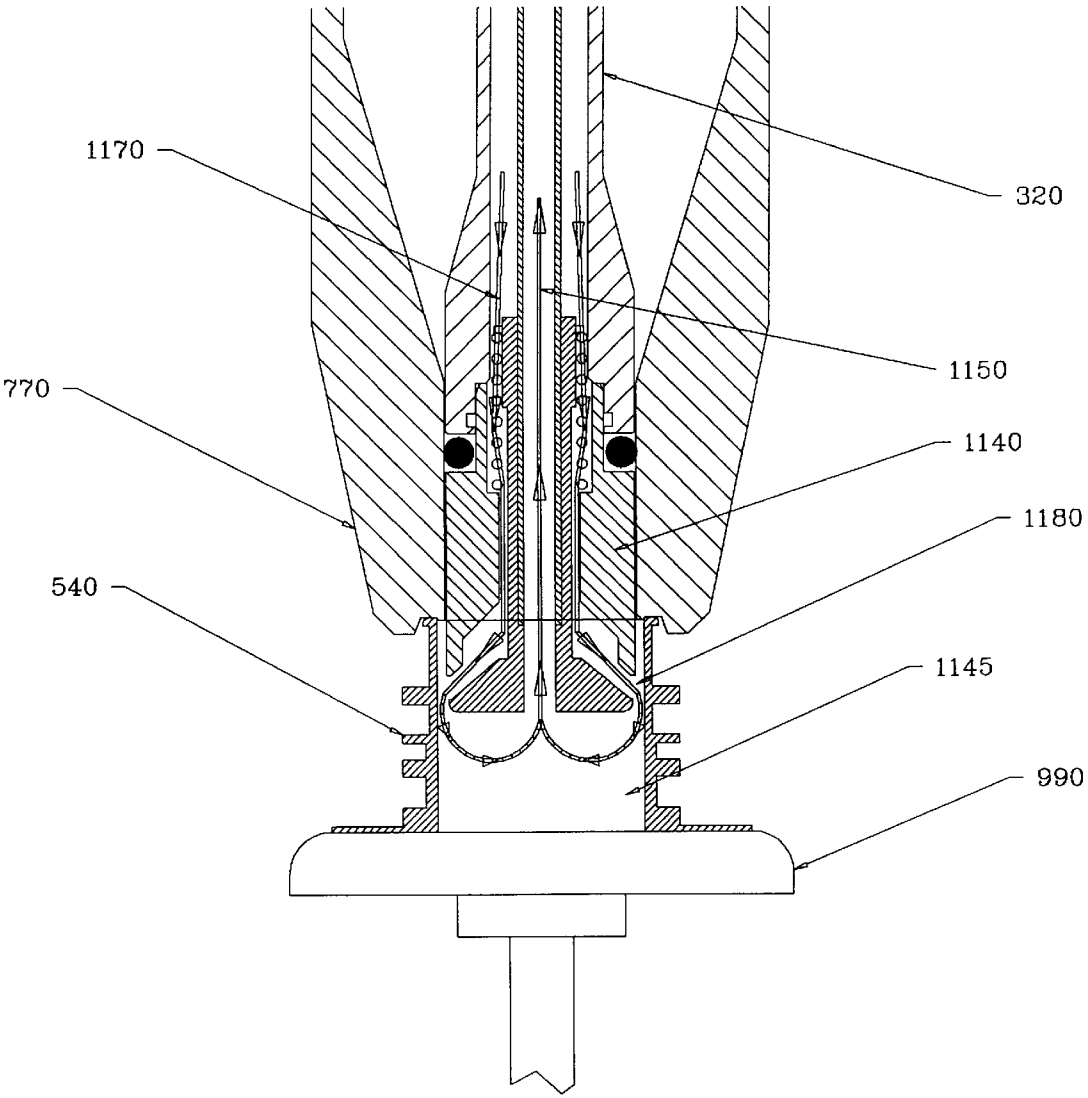
FIG. 16 illustrates a detail cross section diagram of the filling tip.

FIG. 16 shows a preferred embodiment of the present invention. In this preferred embodiment, a cleaning gas such as nitrogen or steam is delivered from the pushing cylinder 1140 to the inner wall of the spout opening 1145 for cleaning the inner wall of the spout opening 1145 when the pushing cylinder 1140 travels from the closed position to the displacement position. The sterile gas is delivered through a gas passage 1170 inside the regulating valve 320 and is injected onto the inner wall of the spout opening 1145 from openings 1180 located at the tip of the pushing cylinder 1140 as shown in the figure. The steam is then escaped from the spout opening 1145 using the inner residual escape path 1150.

In a preferred embodiment, this step of sterilization of the spout opening 1145 can be carried out with saturated steam at a temperature in the range from 140 to 150 C., in which the head space is sterilized with steam arriving at a rate of 50 to 450 m/sec at a temperature 120 to 150 C. The arrival of steam at the rate mentioned above is achieved through an expansion of pressure of the order of 2 to 3 atmospheres.

Figure 17:
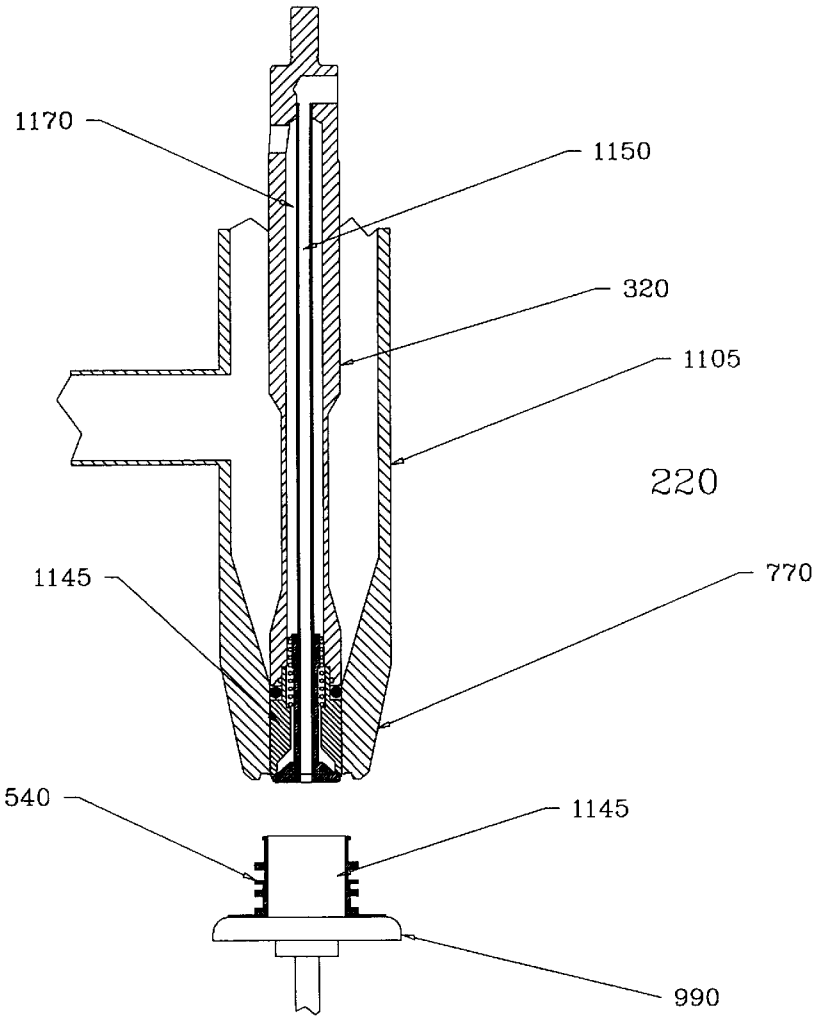
FIG. 17 illustrates the detached position of the filling head.

FIG. 17 shows that when the filling head 220 is disengaged with the spout 540 of the container 510. Because of the subsequent cleaning of the spout opening 1145 and the tight fitting of the pushing cylinder 1140 with the spout opening 1145, there is no dripping of the fluid from the filling tip 770.

Another aspect of the present invention is the novel design of the filling head 220 being able to eliminate or minimize the "water hammer" effect caused by the shutting off of the flow of the fluid between each filling. It is known that at a quick shut off of certain valve of a fluid flowing in a pipe, a pressure shock can occur that exposes the pipe system to strong loads as well as causing noise. This water hammer effect shortens the life expectancy of the pipe used in the filling system, and also causes tremendous noise between each filling. The present invention provides a filling head 220 with a diversion valve design that can eliminate, or at least minimize, this effect.

Figure 18:
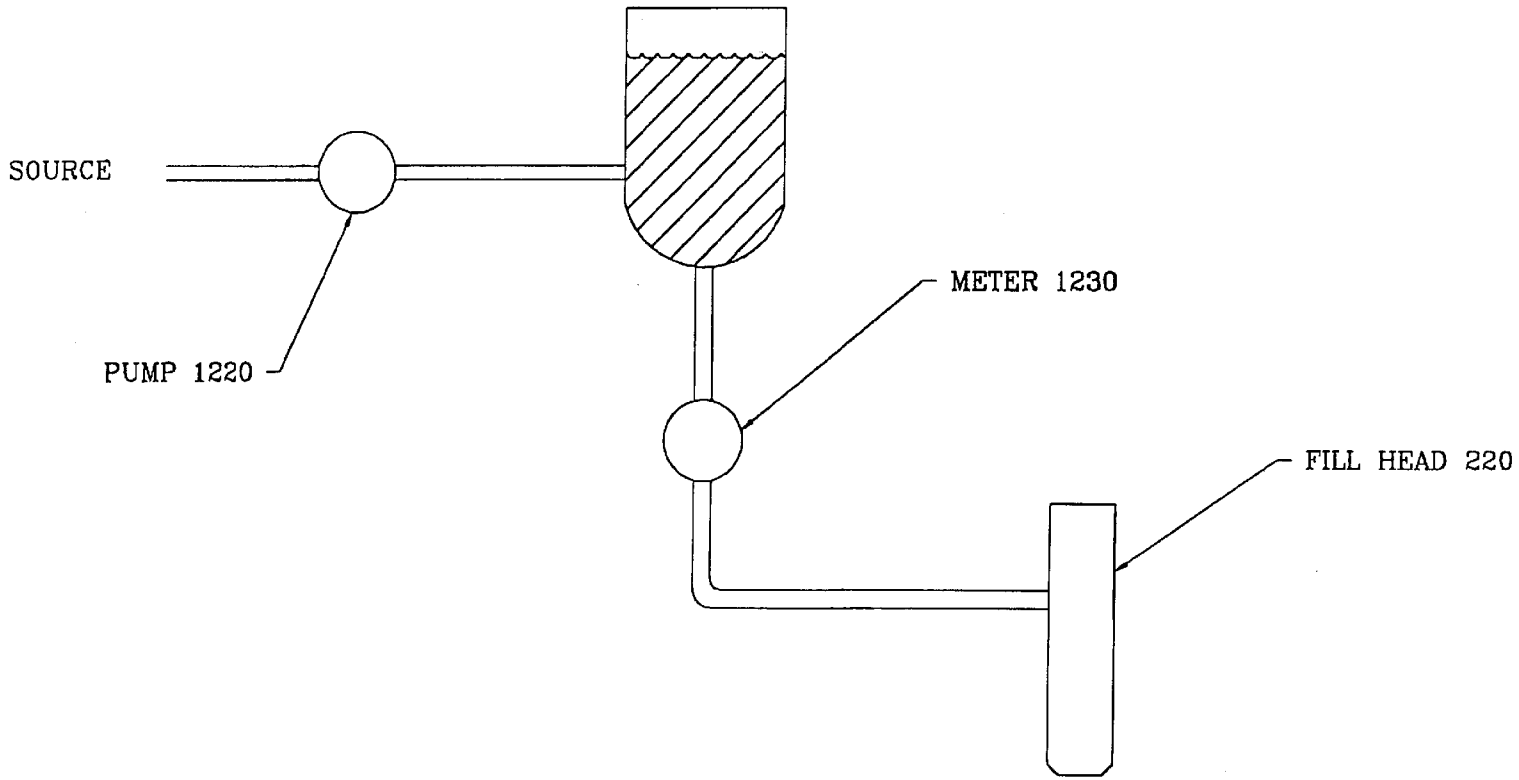
FIG. 18 illustrates a schematic diagram of the filling system.

FIG. 18 shows a schematic diagram of a conventional pumping system.

In the conventional filling system as shown in FIG. 18, the fluid is supplied to the filling head 220 through a fluid inlet 1310 connected to an accumulator 1210. The fluid level in the accumulator 1210 is kept to a predetermined level by adjusting the pressure inside the accumulator 1210. A pump 1220 is employed to pump the fluid to the filling head 220 through the fluid inlet 1310.

In addition, a meter 1230 is connected in series between the accumulator 1210 and the filling head 220 for measuring the amount of fluid flowing into the filling head 220. When a predetermined amount of fluid is flowed into the filling head 220, the pump is stopped to prevent fluid from entering the filling head 220.

Figure 19:
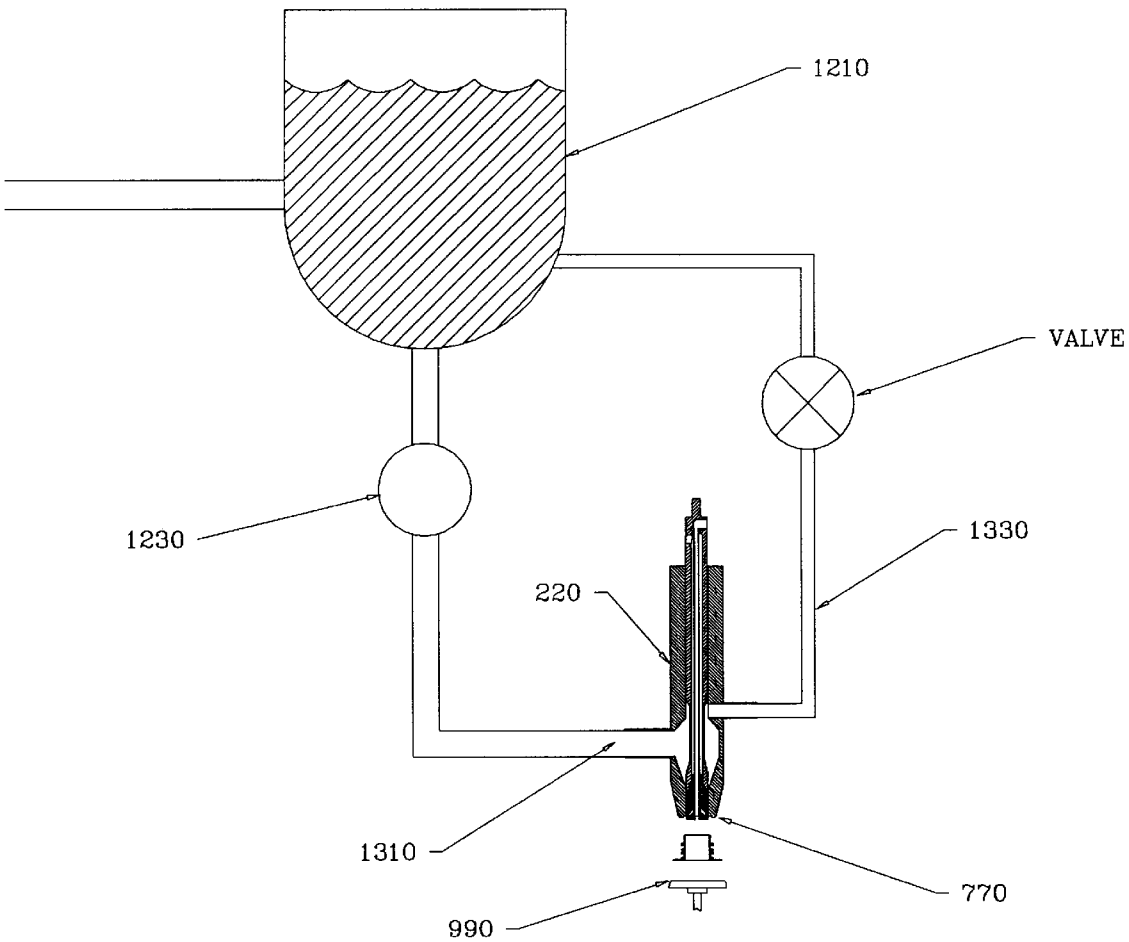
FIG. 19 illustrates a cross section diagram of the filling head of another embodiment.

FIG. 19 shows a filling head 220 of a preferred embodiment of the present invention. The filling head 220 comprises a fluid inlet portion 1310 and a filling tip 770. In addition, the filling head 220 provides a return path 1330 to divert the flow of the fluid when a predetermined amount of fluid is filled to the container 510.

Figure 20:
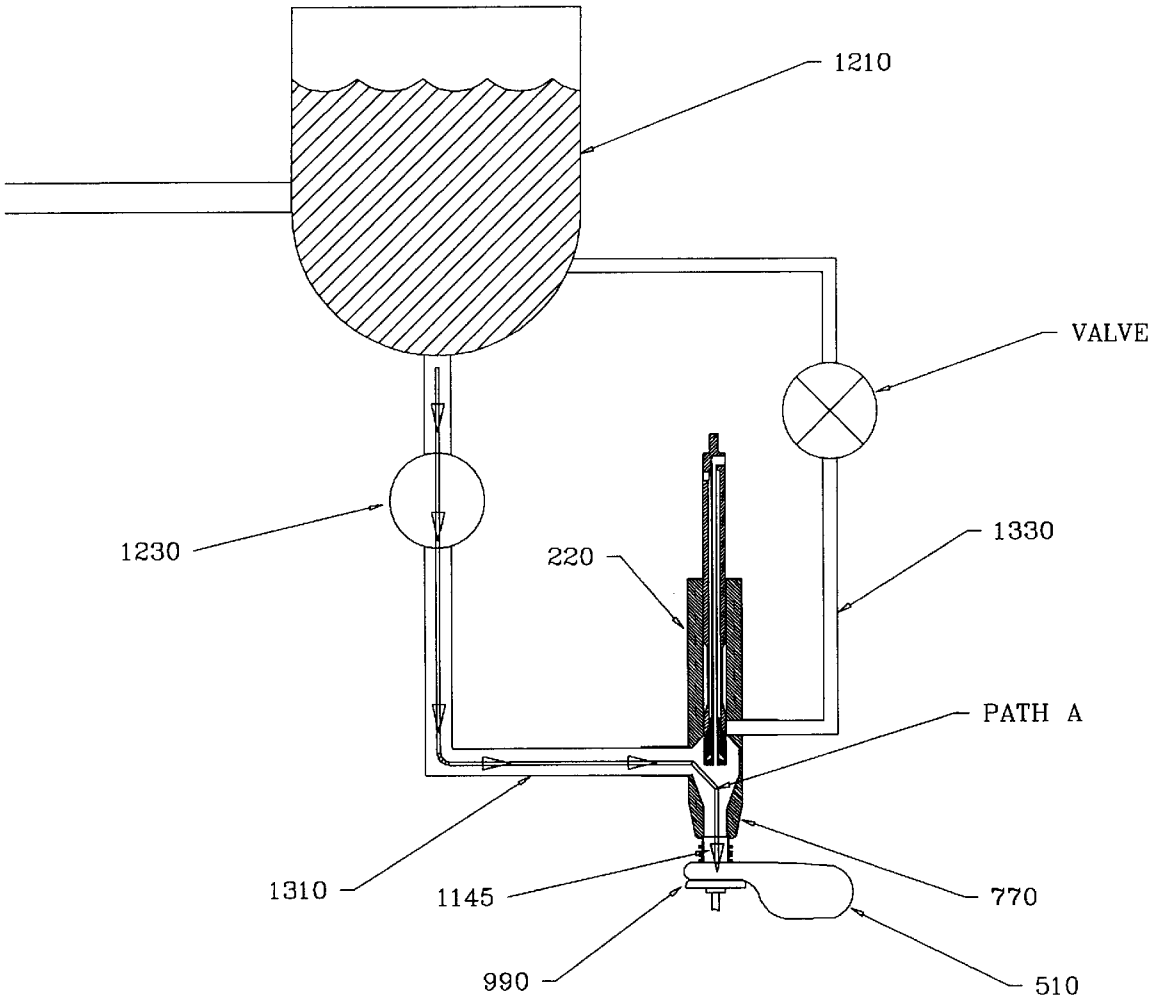
FIG. 20 illustrates the open position of the filling head.
Figure 21:
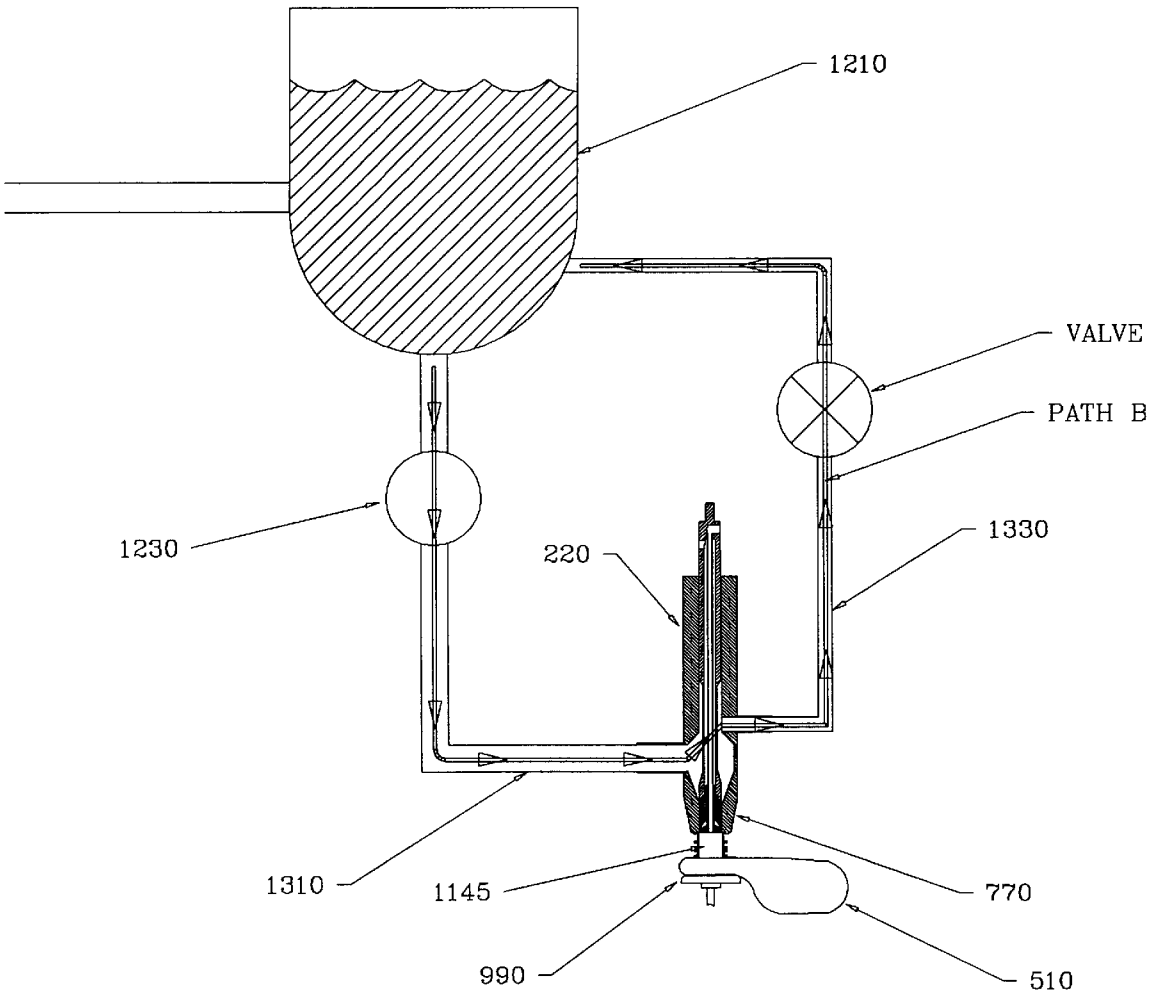
FIG. 21 illustrates the closed position of the filling head.
Figure 22:
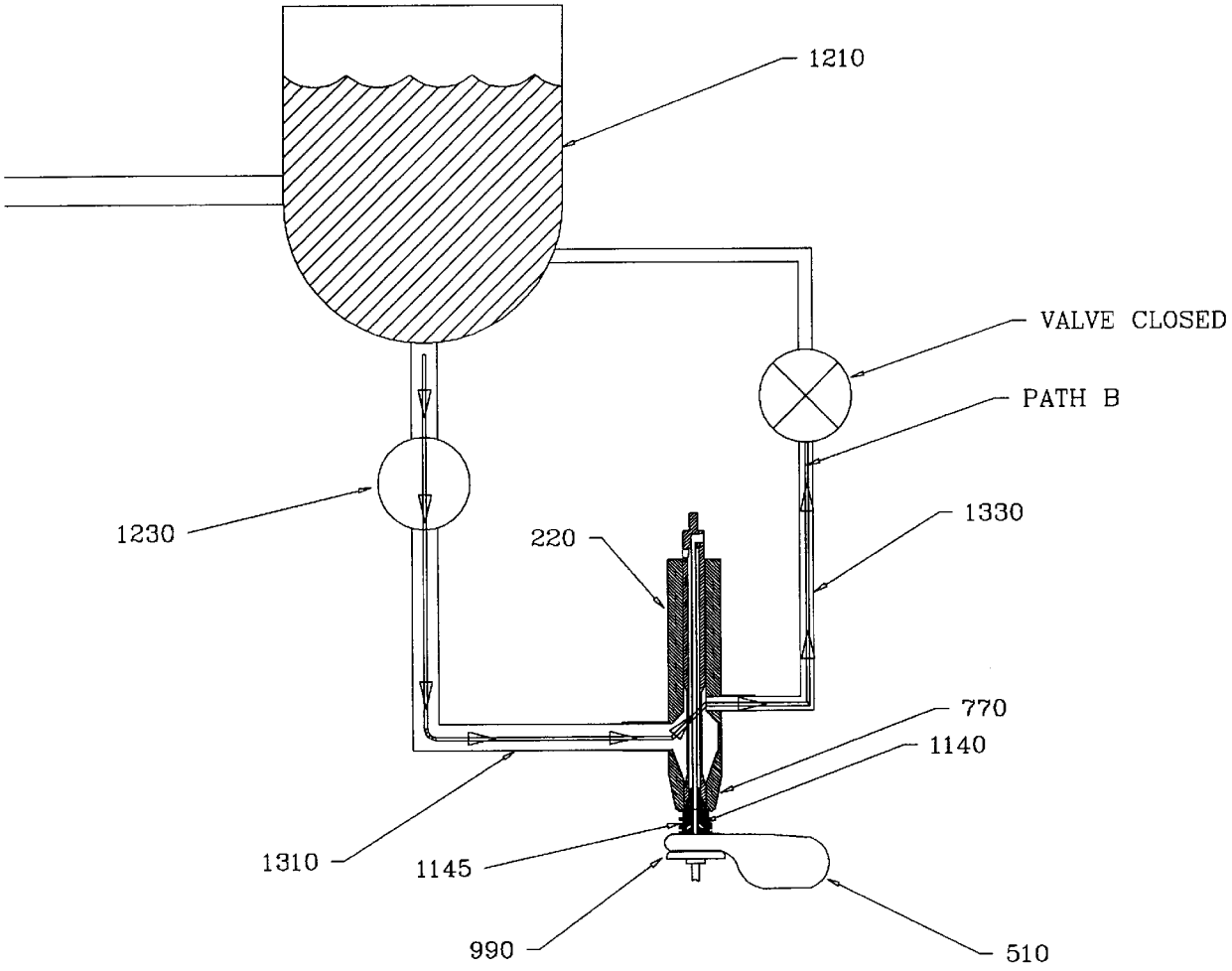
FIG. 22 illustrates the displacement position of the filling head.

The detail operations of the present invention are shown in FIGS. 20, 21, and 22.

FIG. 20 shows the filling head 220 in an open position. In this position, the fluid is allowed to flow from the fluid inlet portion 1310 to the containers through the filling tip 770 and the spout opening 1145 following the path A as shown in FIG. 20. The fluid is pumped into the filling chamber 140 through the inlet portion 1310, then flows into the container 510 through the outlet portion and the spout opening 1145 of the container 510.

When the meter detects the predetermined amount of fluid has been delivered to the container 510, the valve is moved from the open position to a closed position as illustrated in FIG. 21. During the shutting off the flow of liquid to the container 510, a liquid release passage as indicated in the figure is opened for the liquid to flow back to the accumulator 1210 through the return portion 1330. As shown in FIG. 21, the elongated regulating valve 320 is specifically designed to allow the liquid to flow into the return portion 1330 during the shutting off of the regulating valve 320. Instead of instantly shutting off the fluid pump when the predetermined amount of fluid has been filled into the container 510, the filling head 220 of the present invention diverts the flow of the fluid to a return path 1330 as indicated in FIG. 21. By having the fluid return path 1330 to divert the flow of liquid during the shutting off of the fluid into the container 510, the water hammer effect caused by the instantaneously shutting off of the fluid flow can be eliminated, or at least minimized.

FIG. 22 shows the position of the pushing cylinder 1140 when the valve has traveled to the displacement position. In the displacement position, the entire pushing cylinder 1140 is protruded into the spout opening 1145 of the container 510. The return path B is totally open so that the fluid is entirely flowing from the inlet portion 1310 to the return portion.

In another preferred embodiment, there is a shut off valve in the fluid return path 1330 that can be slowly shut off to prevent the water hammer effect.

In another further preferred embodiment, the amount of liquid filled to the container 510 is controlled by the regulating valve 320 alone so that no fluid shut off valve is needed. In this preferred embodiment, the flow of the fluid into the container 510 through the filling tip 770 is controlled by the regulating valve 320 alone. During filling, the valve is in the upward position and the fluid flows into the container 510 following the path C. When the predetermined amount is reached, the valve is then lowered so that the fluid flows through the return path 1330 back to the accumulator 1210. Therefore, the flow of the fluid remains uninterrupted and no shut off valve is needed.

It is to be understood that while the invention has been described above in conjunction with preferred specific embodiments, the description and examples are intended to illustrate and not limit the scope of the invention, which is defined by the scope of the appended claims.

What is claimed is:

1. A filling head apparatus for filling a container having a spout opening for filling, comprising:

a filling head housing defining a filling head chamber, said filling head housing has a fluid inlet portion for receiving fluid to be filled in the container, a filling tip for delivering the fluid to the container;

a regulating valve disposed within said filling head housing for regulating flow of the fluid from said filling head chamber to said container through a spout opening of the container, said regulating valve being displaceable within said filling head housing in at least three positions, said at least three positions comprising an open position, a closed position, and a displacement position, wherein when said regulating valve is in said open position, said fluid is allowed to flow into said container from said filling head chamber, and when said regulating valve is in said closed position and said displacement position, said fluid is blocked to flow from said filling head chamber into said container, and said regulating valve terminates as a pushing cylinder so that when said regulating valve travels from said closed position to said displacement position, said pushing cylinder of the regulating valve protrudes into said spout opening; and an escape path positioned inside said regulating valve for assisting residual fluid to escape from the interior of said spout opening.

2. The filling head apparatus according to claim 1, wherein said pushing cylinder has a diameter substantially equal to a diameter of an inner wall of said spout opening so that when said regulating valve travels from said closed position to said displacement position, said pushing cylinder of said regulating valve compresses against said inner wall of said spout opening for squeezing and removing residual fluid inside the spout opening.

3. The filling head apparatus of claim 1, further comprising:

a steam inlet passage positioned inside said regulating valve for supplying steam to sterilize the inside of said spout opening.

4. The filling head apparatus of claim 3, wherein said steam is injected onto the inner wall of the spout opening.

5. The filling head apparatus of claim 3, wherein said regulative valve further comprises a steam outlet on the pushing cylinder for sterilizing the inside of said spout opening.

6. The filling head apparatus of claim 3, wherein said steam inlet passage and said escape path are separated concentric passages inside said regulative valve.

7. The filling head apparatus of claim 1, further comprising:

a filling chamber encompassing the filling tip.

8. The filling head apparatus of claim 7, wherein said filling chamber is maintained sterile during the filling of the container.

9. The filling head apparatus of claim 7, wherein said filling chamber encompasses a portion of the spout opening of the container during the filling.

10. The filling head apparatus of claim 7, wherein said filling chamber is maintained at a positive pressure of a sterile gas during the filling.

11. The filling head apparatus of claim 10, wherein said sterile gas is nitrogen.

12. The filling head apparatus of claim 11, wherein said sterile gas is steam.

13. The filling head apparatus of claim 11, wherein the filling of the container is performed under a sterile condition.

14. A method for filling a container using a filling head according to claim 1, comprising the steps of:

connecting said filling tip of said filling head with the spout opening of said container;

receiving the fluid to be filled in the container to the filling head housing through the inlet portion;

positioning the regulating valve to the open position;

delivering the fluid through the filling tip of the filling head housing to the container;

positioning the regulating valve to the closed position so that the fluid is blocked from entering into the container; and pushing the regulating valve from the closed position to the displacement position so that the pushing cylinder of said regulating valve compresses against the interior surface of said spout opening and squeezes and removes residual fluid inside the spout opening.

15. A filling head apparatus comprising:

a filling head housing having an inlet portion for receiving fluid from a source to be filled in a container, a filling tip for delivering the fluid to the container, a returning portion for returning the fluid to the source from the filling head housing;

wherein the fluid flows into the filling head housing from the source through an accumulator, and further wherein the fluid flows back into the accumulator through the returning portion when the fluid is diverted from flowing into said container, and a regulating valve positioned within said filling head housing and extends through said filling head housing for regulating flow of the fluid from said filling head housing to the container through the spout opening, said regulating valve having at least two positions, said at least two positions comprising an open position and a closed position, wherein when said regulating valve is in said open position, said fluid is allowed to flow into said container, and wherein when said regulating valve is in said closed position, said fluid is blocked from flowing into said container and is diverted to flow into said returning portion.

16. A filling head apparatus comprising:

a filling head housing having an inlet portion for receiving fluid from a source to be filled in a container, a filling tip for delivering the fluid to the container, a returning portion for returning the fluid to the source from the filling head housing;

an external valve coupled to said returning portion for controlling the flow of the fluid; and a regulating valve positioned within said filling head housing and extends through said filling head housing for regulating flow of the fluid from said filling head housing to the container through the spout opening, said regulating valve having at least two positions, said at least two positions comprising an open position and a closed position, wherein when said regulating valve is in said open position, said fluid is allowed to flow into said container, and wherein when said regulating valve is in said closed position, said fluid is blocked from flowing into said container and is diverted to flow into said returning portion.

17. The filling head according to claim 16, further comprising a meter coupled to the inlet portion to measure the amount of the fluid flowed into the filling head housing.

18. The filling head according to claim 17, wherein the operation of said regulating valve is responsive to said meter.

19. A filling head apparatus comprising:

a filling head housing having an inlet portion for receiving fluid from a source to be filled in a container, a filling tip for delivering the fluid to the container, a returning portion for returning the fluid to the source from the filling head housing;

a regulating valve positioned within said filling head housing and extends through said filling head housing for regulating flow of the fluid from said filling head housing to the container through the spout opening, said regulating valve having at least two positions, said at least two positions comprising an open position and a closed position, wherein when said regulating valve is in said open position, said fluid is allowed to flow into said container, and wherein when said regulating valve is in said closed position, said fluid is blocked from flowing into said container and is diverted to flow into said returning portion; and an escape path positioned inside said regulating valve for allowing residual fluid to escape from the interior of said spout opening.

20. A filling head apparatus comprising:

a filling head housing having an inlet portion for receiving fluid from a source to be filled in a container, a filling tip for delivering the fluid to the container, a returning portion for returning the fluid to the source from the filling head housing;

a regulating valve positioned within said filling head housing and extends through said filling head housing for regulating flow of the fluid from said filling head housing to the container through the spout opening, said regulating valve having at least two positions, said at least two positions comprising an open position and a closed position, wherein when said regulating valve is in said open position, said fluid is allowed to flow into said container, and wherein when said regulating valve is in said closed position, said fluid is blocked from flowing into said container and is diverted to flow into said returning portion; and wherein said at least two positions further comprises a displacement position, and said regulated valve terminates as a pushing cylinder so that when said regulated valve travels from said closed position to said displacement position, said pushing cylinder of the regulated valve protrudes into said spout opening;

and wherein said filling head further comprises an escape path positioned inside said regulating valve for assisting residual fluid to escape from the interior of said spout opening.

21. The filling head apparatus according to claim 20, wherein said pushing cylinder has a diameter substantially equal to a diameter of an inner wall of said spout opening so that when said regulating valve travels from said closed position to said displacement position, said pushing cylinder of said regulating valve compressing against said inner wall of said spout opening for squeezing and removing residual fluid inside the spout opening.

22. The filling head apparatus of claim 20, further comprising:

a steam inlet passage positioned inside said regulating valve for supplying steam to sterilize the inside of said spout opening.

23. The filling head apparatus of claim 22, wherein said steam is injected onto the inner wall of the spout opening.

24. The filling head apparatus of claim 22, wherein said regulating valve further comprises a steam outlet on the pushing cylinder.

25. The filling head apparatus of claim 22, wherein said steam inlet passage and said escape path are separated concentric passages inside said regulating valve.

26. The filling head apparatus of claim 20, further comprising:

a filling chamber encompassing the filling tip.

27. The filling head apparatus of claim 26, wherein said filling chamber is maintained sterile during the filling of the container.

28. The filling head apparatus of claim 26, wherein said filling chamber encompasses a portion of the spout opening of the container during the filling.

29. The filling head apparatus of claim 26, wherein said filling chamber is maintained at a positive pressure of a sterile gas during the filling.

30. A filling head apparatus comprising:

a filling head housing having an inlet portion for receiving fluid from a source to be filled in a container, a filling tip for delivering the fluid to the container, a returning portion for returning the fluid to the source from the filling head housing;

a regulating valve positioned within said filling head housing and extends through said filling head housing for regulating flow of the fluid from said filling head housing to the container through the spout opening, said regulating valve having at least two positions, said at least two positions comprising an open position and a closed position, wherein when said regulating valve is in said open position, said fluid is allowed to flow into said container, and wherein when said regulating valve is in said closed position, said fluid is blocked from flowing into said container and is diverted to flow into said returning portion; and wherein the filling of the container is performed under a sterile condition.

31. A device for aseptically filling a container through a spout thereof with fluid in a sterile environment, comprising:

an enclosed sterile chamber having a first opening in a wall thereof for accepting the container spout;

a gripper mechanism positioned outside of said chamber to engage the spout of the container and move the spout into and out of the first chamber opening;

a filling head extended into the sterile chamber through a second opening for providing the fluid to the container, said filling head being movable with respect to the sterile chamber for engaging to the spout of the container within the chamber, wherein when said filling head engages the spout of the container, the fluid flows from said filling head to the container through said spout of the container; and a mechanism positioned within said chamber to remove and replace a cap of the container spout when inserted through the first chamber opening and the filling head is removed from engagement with the spout.

32. The device according to claim 31, wherein said filling head moves substantially along a longitudinal axis of the container spout when the spout is positioned in the chamber through the first opening.

33. The device according to claim 31, wherein the sterile chamber is maintained at positive pressure with a sterile gas during the filling.

34. The device according to claim 31, wherein the gripper mechanism is characterized by positioning the spout through the first chamber opening by a first distance when the cap mechanism operates to remove and replace the cap on the container spout and a second distance when the filling head engages the container spout to fill the container with fluid, the first distance being greater than the second distance.

35. A device for aseptically filling a container with fluid in a sterile environment, comprising:

an enclosed sterile chamber having a first opening in a wall thereof for accepting a spout of the container;

a filling head extended into the sterile chamber through a second opening for providing the fluid to the container, said filling head is able to move independently with respect to the sterile chamber for engaging to the spout of the container, wherein when said filling head is engaging with the spout of the container, the fluid flows from said filling head to the container through said spout of the container; and a rolling diaphragm seal positioned between the filling head and the second opening of the sterile chamber for preventing contamination from entering the sterile chamber.

36. A device for aseptically filling a container with fluid in a sterile environment, comprising:

an enclosed sterile chamber having a first opening in a wall thereof for accepting a spout of the container;

a filling head extended into the sterile chamber through a second opening for providing the fluid to the container, said filling head is able to move independently with respect to the sterile chamber for engaging to the spout of the container, wherein when said filling head is engaging with the spout of the container, the fluid flows from said filling head to the container through said spout of the container; and wherein said filling head is hingedly coupled with the sterile chamber so that the filling head moves substantially along a longitudinal axis of the spout of the container.

37. A device for aseptically filling a container with fluid in a sterile environment, comprising:

an enclosed sterile chamber having a first opening in a wall thereof for accepting a spout of the container; and a filling head extended into the sterile chamber through a second opening for providing the fluid to the container, said filling head is able to move independently with respect to the sterile chamber for engaging to the spout of the container, wherein when said filling head is engaging with the spout of the container, the fluid flows from said filling head to the container through said spout of the container, said filling head further comprising:

a filling head housing defining a filling head chamber, said filling head housing has a fluid inlet portion for receiving the fluid to be filled in the container, a filling tip for delivering the fluid to the container;

a regulating valve disposed within said filling head housing for regulating flow of the fluid from said filling head chamber to said container through a spout opening of the container, said regulating valve being displaceable within said filling head housing in at least three positions, said at least three positions comprising an open position, a closed position, and a displacement position, wherein when said regulating valve is in said open position, said fluid is allowed to flow into said container from said filling head chamber, and when said regulated valve is in said closed position and said displacement position, said fluid is blocked to flow from said filling head chamber into said container, and said regulated valve terminating as a pushing cylinder so that when said regulated valve travels from said closed position to said displacement position, said pushing cylinder of the regulated valve protrudes into said spout opening; and an escape path positioned inside said regulating valve for allowing residual fluid to escape from the interior of said spout opening.

38. The filling head apparatus according to claim 37, wherein said regulating valve terminates, at the filling tip, as a pushing cylinder having a diameter substantially equal to a diameter of an inner wall of said spout opening so that when said regulating valve travels from said closed position to said displacement position, said pushing cylinder of said elongate regulating valve compresses against said inner wall of said spout opening and squeezes and removes residual fluid inside the spout opening.

39. The filling head apparatus of claim 37, further comprising:

a filling chamber encompassing the filling tip.

40. The filling head apparatus of claim 39, wherein said filling chamber is maintained sterile during the filling of the container.

41. The filling head apparatus of claim 40, wherein said filling chamber encompasses a portion of the spout opening of the container during the filling.

42. The filling head apparatus of claim 39, wherein said filling chamber is maintained at a positive pressure of a sterile gas during the filling.

43. A method of filling a container with liquid through an opening of a spout thereof that contains a cap attached thereover, comprising:

positioning the capped container spout through a first opening of a chamber, thereafter gripping the cap within the chamber in order to cause its removal from the spout, thereafter removing the spout a distance through the first chamber opening but maintaining the spout opening within the chamber, thereafter moving a filling head nozzle through a second opening of the chamber to engage the spout opening within the chamber, thereafter discharging liquid through the filling head nozzle and through the spout into the container, thereafter removing the filling head nozzle from engaging the container spout opening, thereafter moving the spout further into the chamber through the first opening, and positioning the cap onto the spout within the chamber, and removing the capped spout from the chamber through the first opening.

44. A filling head assembly for filling a container with liquid through a spout thereof, comprising:

a filling head housing defining a filling head chamber, said filling head housing having a liquid inlet portion for receiving liquid with which the container is filled, and a filling tip that engages the container spout to deliver liquid therethrough;

a regulating valve disposed within said filling head housing for regulating flow of the liquid from said filling head chamber to said container through the container spout opening, said regulating valve being moveable within said filling head housing along an axis thereof among at least an open position, a closed position, and a displacement position, wherein when said regulating valve is in said open position, said liquid is allowed to flow into said container from said filling head chamber, and when said regulated valve is in said closed position and said displacement position, said liquid is blocked from flowing from said filling head chamber into said container, and said regulated valve terminates as a pushing cylinder so that when said regulated valve travels from said closed position to said displacement position, said pushing cylinder of the regulated valve protruding into said spout opening, said pushing cylinder having a diameter substantially equal to a diameter of an inner wall of said spout opening so that when said regulating valve travels from said closed position to said displacement position, said pushing cylinder of said regulating valve removes residual liquid from inside the spout opening.

45. The filing head assembly of claim 44, additionally comprising an escape path positioned inside of said regulating valve through which said residual liquid may pass from within the spout opening.

46. The filling head assembly of claim 44, additionally comprising a system that flushes a fluid through the spout after the pushing cylinder has been removed therefrom, thereby to remove additional residual liquid from the container spout.

47. The filing head assembly of claim 46, wherein said flushing system includes an escape path positioned inside of said regulating valve.

* * * * *